US009827785B1

(12) United States Patent
Davis et al.

(10) Patent No.: US 9,827,785 B1
(45) Date of Patent: Nov. 28, 2017

(54) APPARATUS AND METHOD FOR PRINTING ON A CURVED GLASS SURFACE

(71) Applicant: McKenzie Sports Products, LLC, Salisbury, NC (US)

(72) Inventors: Chad Matthew Davis, Rockwell, NC (US); Bradley A. Eppley, Millerburg, OH (US)

(73) Assignee: MCKENZIE SPORTS PRODUCTS, LLC, Salisbury, NC (US)

( * ) Notice: Subject to any disclaimer, the term of this patent is extended or adjusted under 35 U.S.C. 154(b) by 0 days.

(21) Appl. No.: 15/253,117

(22) Filed: Aug. 31, 2016

Related U.S. Application Data

(60) Provisional application No. 62/212,906, filed on Sep. 1, 2015.

(51) Int. Cl.
*B41J 3/407* (2006.01)

(52) U.S. Cl.
CPC ..... *B41J 3/4073* (2013.01)

(58) Field of Classification Search
CPC ..... B41J 3/4073
See application file for complete search history.

(56) References Cited

U.S. PATENT DOCUMENTS

2010/0186610 A1* 7/2010 Polk ..... B41J 3/4073 101/35

* cited by examiner

*Primary Examiner* — Bradley Thies
(74) *Attorney, Agent, or Firm* — Moore & Van Allen PLLC; Nicholas C. Russell

(57) ABSTRACT

Embodiments of the invention are directed to systems and methods for printing on a convex or concave glass surface and for an apparatus for holding the one or more work pieces for printing. The invention operatively couples one or more curved pieces in a mounting fixture, wherein each of the one or more curved pieces comprise a convex surface or a concave surface. Furthermore, the invention accesses a flattened image of the convex outer surface or the concave inner surface of one or more generally curved pieces and disposes pigment on the convex surface or the concave surface of the one or more curved pieces according to the flattened image. Further embodiments may be directed towards printing on curved pieces such as glass eyes.

6 Claims, 16 Drawing Sheets

APPARATUS AND METHOD FOR PRINTING ON A CURVED GLASS SURFACE

CROSS-REFERENCE OF RELATED APPLICATIONS

This application claims priority to U.S. Provisional Patent Application No. 62/212,906 filed Sep. 1, 2015 and titled "Apparatus and Method for Printing on a Curved Glass Surface" the contents of which hereby incorporated by reference.

BACKGROUND

With advancements in printing technology, printing high quality images onto flat glass has become possible. However, utilizing digital printing technologies, it is still difficult to present and accurately print high quality images onto curved pieces. In taxidermy, for example, it is customary to place glass eyes in the mounted animals to provide an increased realism. The glass eyes are typically curved in shape with convex and concave surfaces. In order to create a realistic effect, each of the eye surfaces must be painted. This has generally been accomplished either by hand painting, screen printing, or filling the convex portion of the eye with a material to resemble a colored eye. In each case, time and resources are needed to complete a final product.

BRIEF SUMMARY

Embodiments of the invention are directed to methods for printing on a convex or concave surface and for an apparatus for holding one or more work pieces for printing. In some embodiments, the invention operatively couples one or more curved work pieces in a mounting fixture, wherein each of the one or more curved pieces comprise a convex surface or a concave surface. Further the invention may access a flattened image of the convex outer surface or the concave inner surface of one or more generally curved pieces. Using a flattened image, the invention may dispose pigment on the convex surface or the concave surface of the one or more curved pieces according to the flattened image.

In some embodiments, the mounting fixture comprises a backing fixture and a tray fixture. The tray fixture is capable of holding the curved pieces. Additionally, the tray fixture comprises apertures positioned in rows relative to each other. Each aperture is connected to at least one adjacent aperture by a groove in the tray fixture.

In some embodiments, the tray fixture further comprises one or more silicone or rubber holders, wherein the one or more holders are operatively coupled into the apertures and grooves of the tray fixture. In some embodiments, each of the holders are configured to operatively couple with one of the one or more curved pieces such that the holders covers at least a portion of the convex surface of the one curved piece operatively coupled to the holder.

In some embodiments, the backing fixture comprises a mounting surface configured to support the curved pieces on an adjoining surface of the one or more curved pieces that are adjacent to the concave surface such that the adjoining surface of each of the one or more curved class pieces contacts the mounting surface such that the convex outer surface is exposed for printing. The backing fixture further comprises a gasket located over the mounting surface and the gasket comprises apertures exposing the mounting surface and configured to operatively couple the curved pieces when the adjoining surface of each of the curved pieces contacts the mounting surface.

In some embodiments, the invention creates the flattened image of the convex surface or the concave surface by receiving a 3-D image of a printed convex surface or the concave surface and generating the 2-D image of the convex surface or the concave surface by distorting the 3-D image relative to the convex surface or the concave surface.

In some embodiments, disposing pigment comprises disposing frit ink on to a preheated convex surface or a concave surface of the one or more curved pieces in sequential steps based on the flattened image of the convex surface or the concave surface. Preheating the generally curved pieces is completed using an infrared heat source.

In some embodiments of the invention, the invention is directed to operatively coupling one or more generally curved shape work pieces in a tray fixture associated with a mounting fixture. Each of the one or more curved pieces comprises a convex outer surface and a concave inner surface. The tray fixture is capable of holding multiple curved pieces to present the concave inner surface for printing. The invention may further access a first flattened image of the concave inner surface of the one or more generally curved pieces. Based on the flattened image, the invention disposes color pigment on the concave surface of the one or more generally curved pieces. Preparing the curved pieces to be printed on the convex outer surface, the invention releasably attaches the tray fixture to a backing fixture associated with the mounting fixture via registration points associated with both the tray fixture and the backing fixture. Further, the invention releases the one or more generally curved pieces from the tray fixture to the backing fixture upon inversion of the mounting fixture, such that the one or more generally curved pieces are operatively coupled to the backing fixture. The backing fixture is capable of holding the one or more curved pieces to present the convex outer surface for printing. Similar to accessing the first flattened image, the invention accesses a second flattened image of the convex outer surface of the one or more generally curved pieces and disposes color pigment on the convex outer surface of the one or more generally curved pieces according to the second flattened image.

In some embodiments, the tray fixture comprises apertures positioned in rows relative to each other. Each aperture is connected to a laterally adjacent aperture by a groove within the tray fixture. Further, a silicone or rubber holder that is operatively coupled into the apertures and grooves of the tray fixture, and wherein the holder comprises rings. Each of the rings comprise a flat outer surface configured to contact an inner surface of one of the apertures of the tray fixture, and each of the rings further comprises a semi-torus inner surface configured to operatively couple with one of the one or more curved pieces such that each of the rings cover at least a portion of the convex surface of each of the curved pieces operatively coupled to the ring.

In some embodiments, the backing fixture comprises a mounting surface configured to support the curved pieces on an adjoining surface of the one or more curved pieces that are adjacent to the concave surface such that the adjoining surface of each of the one or more curved class pieces contacts the mounting surface such that the convex outer surface is exposed for printing. The backing fixture further comprises a gasket located over the mounting surface. The gasket comprises apertures exposing the mounting surface and configured to operatively couple the curved pieces when the adjoining surface of each of the curved pieces contacts the mounting surface.

In some embodiments, the invention is further configured to create the first flattened surface of the concave inner surface and the second flattened surface of the convex outer surface by receiving 3-D images of a printed concave inner surface and a printed convex outer surface generating the flattened image of the concave inner surface and the flattened image of the convex outer surface by distorting the 3-D images relative to the printed concave inner surface and the printed convex outer surface.

In some embodiments, the invention is further directed towards printing on a curved work piece that is a glass eye. To print on a glass eye, the invention may be configured to operatively coupling one or more glass eyes in a tray fixture associated with a mounting fixture. Each of the one or more glass eyes comprises a substantially aspherical or hemispherical convex outer surface and an aspherical or hemispherical concave inner surface. The tray fixture is capable of holding the one or more glass eyes to present the concave inner surface of the one or more glass eyes for printing.

Further, in some embodiments, the invention disposes color pigment on the concave inner surface of the one or more glass eyes and releasably attaches the tray fixture to a backing fixture associated with the mounting fixture via registration points associated with both the tray fixture and the backing fixture. With the tray fixture and the backing fixture releasably attached, the invention is directed to releasing the one or more glass eyes from the tray fixture to the backing fixture upon inversion of the mounting fixture, such that the one or more glass eyes are operatively coupled to the backing fixture, wherein the backing fixture is capable of holding the one or more glass eyes to present the convex outer surface of the one or more glass eyes for printing. Lastly, the invention disposes color pigment on the convex outer surface of the one or more glass eyes.

Each of the one or more glass eyes further comprises a plurality of spaced discontinuous grooves formed in the concave inner surface of each of the one or more glass eyes, wherein each groove of the plurality of grooves being straight or curvilinear in different directions along the length of the groove to provide each of the one or more glass eyes with a natural appearance of depth and liquidity when printed, wherein a first flattened image comprises instructions for printing the plurality of grooves, and wherein disposing color pigment in a form of frit ink on the concave inner surface comprises printing the plurality of grooves based on the instructions for printing the plurality of grooves and an orientation of the one or more glass eyes in the tray fixture. In other embodiments, the invention creates a first flattened image of the concave inner surface and a second flattened image of the convex outer surface by receiving 3-D images of a printed concave inner surface and a printed convex outer surface, and generating the flattened image of the concave inner surface and the flattened image of the convex outer surface by distorting the 3-D images relative to the concave inner surface and the convex outer surface.

In some embodiments, the tray fixture comprises apertures positioned in rows. Each aperture is connected to an adjacent lateral aperture by a groove in the tray fixture. One or more rubber or silicone holders are operatively coupled to the apertures and grooves of the tray fixture.

The tray fixture comprises apertures positioned in rows relative to each other. Each aperture is connected to a laterally adjacent aperture by a groove within the tray fixture. A silicone or rubber holder is operatively coupled into the apertures and grooves of the tray fixture, and wherein the holder comprises rings, wherein each of the rings comprise a flat outer surface configured to contact an inner surface of one of the apertures of the tray fixture. Each of the rings further comprises a semi-torus inner surface configured to operatively couple with one of the one or more glass eyes such that each of the rings cover at least a portion of the convex surface of each of the one more glass eyes operatively coupled to the ring.

In some embodiments, each of the one or more holders comprise multiple rings formed into each of the holders and each of the rings comprise a semi-torus inner surface configured to operatively couple with one of the one or more glass eyes such that each of the rings cover at least a portion of the convex surface of each of the one more glass eyes operatively coupled to the ring.

In some embodiments, the backing fixture comprises a mounting surface configured to support the one or more glass eyes on an adjoining surface of the one or more glass eyes that are adjacent to the concave surface such that the adjoining surface of each of the one or more glass eyes contacts the mounting surface such that the convex outer surface is exposed for printing. The backing fixture further comprises a gasket located over the mounting surface. The gasket comprises apertures exposing the mounting surface and configured to operatively couple the glass eyes when the adjoining surface of each of the glass eyes contacts the mounting surface.

In some embodiments, the invention is directed to preheating the one or more glass eyes, wherein preheating the hemispherical glass pieces is completed using an infrared heat source. Further, the invention may dispose color pigment comprises disposing different colors of frit ink in subsequent steps and heating the one or more glass eyes to cure the frit ink. Yet in other embodiments, the invention is directed to cleaning the one or more glass eyes prior to disposing the frit ink on the one or more glass eyes.

Embodiments of the invention are directed to apparatus for positioning and holding one or more work pieces for exposing a curved pieces of the one or more work pieces for printing. In some embodiments, the apparatus comprises a mounting fixture. The mounting fixture comprises a tray fixture and a backing fixture where the tray fixture and the backing fixture are capable of being releasably attached.

In some embodiments, the tray fixture comprises apertures positioned in a row, and one or more holders within and operatively coupled to the apertures. Each of the one or more holders are configured to operatively couple with a generally convex outer surface of the one or more work pieces to reveal a second surface of each of the one or more work pieces. Further, the backing fixture comprises a mounting surface configured to support the one or more work pieces to present a generally convex surface of each of the one or more work pieces for printing.

In some embodiments, the backing fixture further comprises a gasket located over the mounting surface. The gasket comprises apertures configured to expose the mounting surface of the backing fixture and operatively couple with the one or more work pieces when the one or more work pieces are supported by the mounting surface. In other embodiments, laterally adjacent apertures of the tray fixture are connected by grooves within the tray fixture.

A thickness of the tray fixture is determined by the one or more work pieces, wherein the tray fixture thickness is great enough that when the one or more work pieces are operatively coupled to the tray fixture, a portion of the one or more work pieces does not extend pass a bottom surface of the tray fixture. Additionally, a width of the backing fixture is less than the tray fixture thus exposing at least part of the tray fixture when the backing fixture and the tray fixture are releasably attached, wherein the exposed part of the tray fixture enables a user to release the tray fixture from the backing fixture.

In some embodiments, the mounting fixture is configured to register the one or more work pieces to the tray fixture for operatively coupling the one or more work pieces to the tray fixture. The mounting fixture is further configured to register the backing fixture to the tray fixture for releasably attaching the tray fixture with the backing fixture. The mounting fixture is further configured to be inverted to expose at least a portion of the one or more work pieces for applying a force to the one or more work pieces. When the force is applied to the one or more work pieces, the one or more work pieces are decoupled from the tray fixture and are operatively coupled to the upper tray.

In some embodiments, each of the one or more holders comprises a semi-torus surface configured to operatively couple one of the one or more work pieces. Each of the one or more holders further comprise a flat surface located that operatively couples to an inside surface of one of the apertures of the tray fixture. When one of the work pieces is operatively coupled to the semi-torus surface of one of the holders, the semi-torus surface molds to the convex outer surface of the one work piece operatively connected to the semi-torus surface. Further, the holders operatively couple to the tray fixture. The gasket of the backing fixture are made of rubber or silicone.

In some embodiments, the tray fixture and the backing fixture comprise matching registration points. The registration points are located on the tray fixture and the backing fixture such that when the registration points are aligned, the one or more holders operatively coupled to the apertures of the tray fixture align with exposed mounting surface of the backing fixture.

In some embodiment, at least one of the one or more holders comprises multiple apertures. Each of the apertures comprises a semi-torus shaped surface that operatively couples to one of the work pieces. In some embodiments, the one of the one or more work pieces are made of glass.

In some embodiment of the invention, the invention is directed to a mounting fixture for holding one or more work pieces for disposing pigment on the one or more work pieces. The mounting fixture includes a tray fixture and the tray fixture comprises apertures positioned in a row, and one or more holders within and operatively coupled to the apertures. Each of the one or more holders are comprise a semi-torus inner surface configured to operatively couple to a convex surface of one of the one or more work pieces to reveal a concave inner surface of the work piece operatively coupled to the semi-torus inner surface. The mounting fixture further comprises a backing fixture, where the backing fixture comprises a mounting surface configured to support the one or more work pieces to present the convex surface of each of the one or more work pieces.

In some embodiments, the mounting fixture is configured to operatively couple to a tray holder configured to hold multiple mounting fixtures. The tray holder comprises one or more indentions formed into the tray holder configured to operatively couple and/or orientate the multiple mounting fixtures for printing the one or more work pieces that are operatively coupled to the multiple mounting fixtures.

In some embodiments, the invention is directed towards an apparatus for holding one or more glass eyes for applying pigment. The apparatus includes a mounting tray holder, one or more mounting fixtures operatively coupled to the mounting tray holder and configured to operatively couple with one or more glass eyes for printing the one or more glass eyes. Each of the one or more mounting fixtures comprises a tray fixture and a backing fixture. The tray fixture may be releasably attached to the backing fixture, wherein the tray fixture is configured to operatively couple with a convex outer surface of the one or more glass eyes to reveal a concave inner surface of the one or glass eyes for applying pigment. Further, the backing fixture comprises a mounting surface, registration points, and a gasket, the mounting surface configured to support the one or more work pieces to present the convex surface of one or more glass eyes, the gasket being positioned over the mounting surface and being composed of silicone. The gasket comprises one or more apertures exposing the mounting surface. The apertures allow the one or more glass eyes to be seated on the mounting surface and wherein the gasket operatively couples the glass eye to the mounting surface to present the convex surface of the one or more glass eyes for applying pigment.

In some embodiments, the tray holder comprising an indention configured to the one or more mounting fixtures, wherein the tray holder comprises one or more indentions formed into the tray holder configured to operatively couple and/or orientate the multiple mounting fixtures for printing the one or more work pieces that are operatively coupled to the one or more mounting fixtures.

In some embodiments, each of the tray fixtures comprise one or more holders operatively coupled to the tray fixtures wherein each of the one or more holders comprise a torus-shaped outer surface configured to operatively couple the convex surface of the one or more glass eyes for exposing the concave surface of each of the one or more glass pieces for printing. Further, each of the one or more holders further comprise a flat outer surface that is configured to operatively couple with an inner surface of the one or more apertures of the tray fixture.

In some embodiments, each of the one or more glass eyes further comprises a plurality of spaced discontinuous grooves formed in the concave inner surface of each of the one or more glass eyes, wherein each groove of the plurality of grooves being straight or curvilinear in different directions along the length of the groove to provide each of the one or more glass eyes with a natural appearance of depth and liquidity when painted. The one or more holders position each of the one or more glass eyes for printing each of the plurality of spaced discontinuous grooves.

BRIEF DESCRIPTION OF THE DRAWINGS

Figure 1:
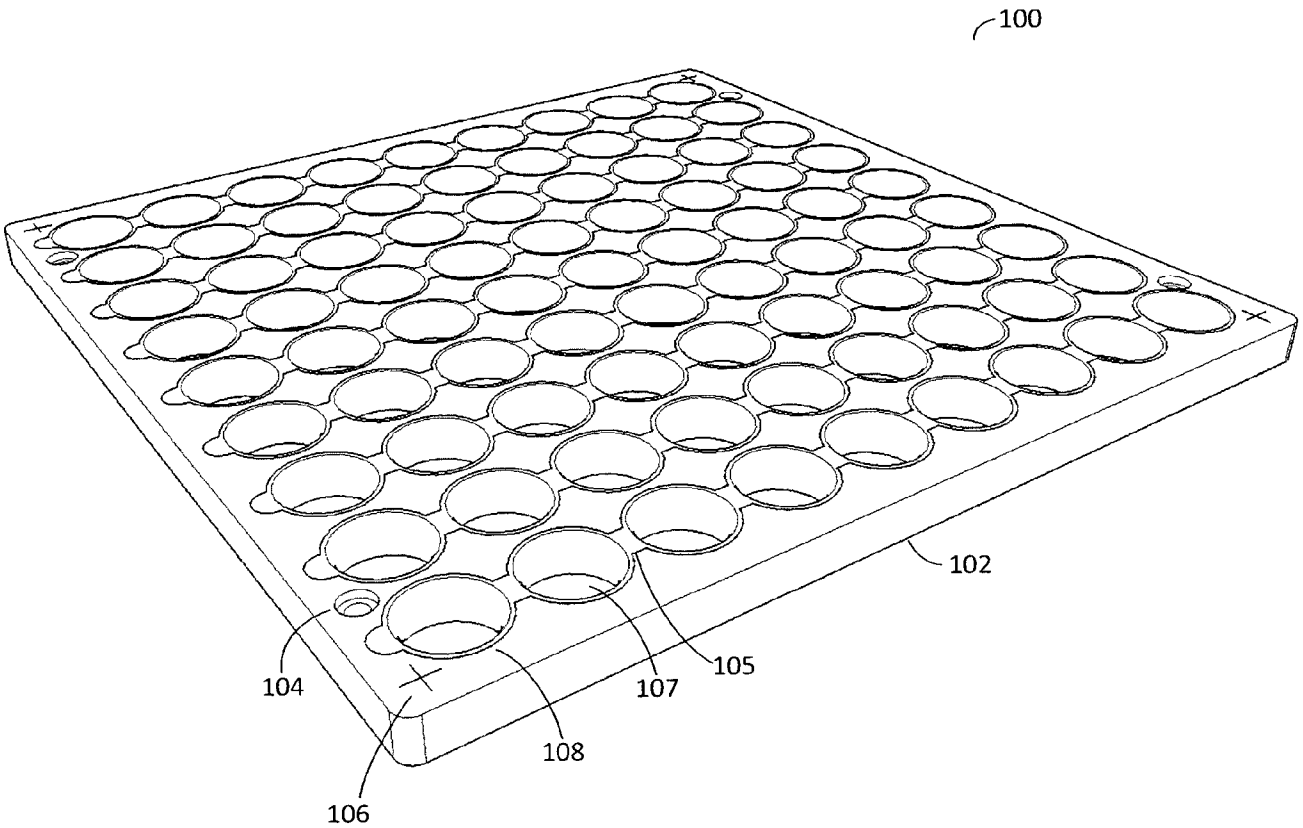
Figure 2A:
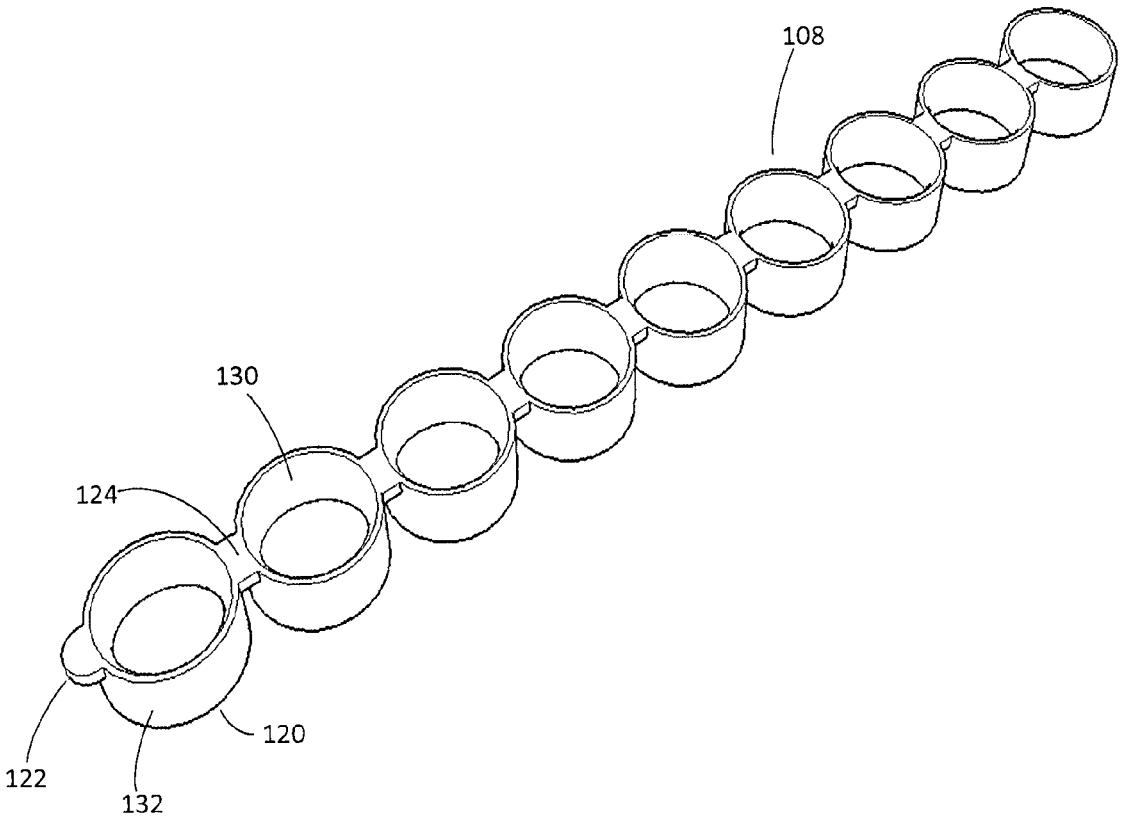
Figure 2B:
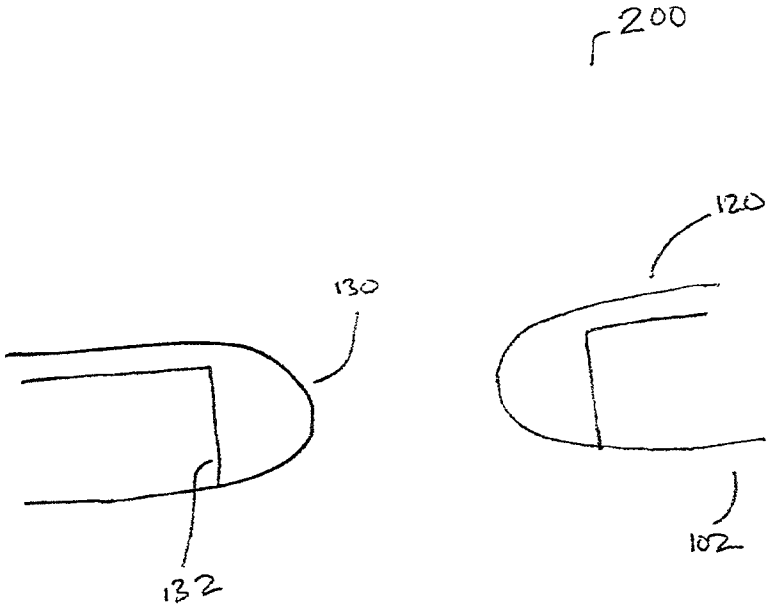
Figure 3:
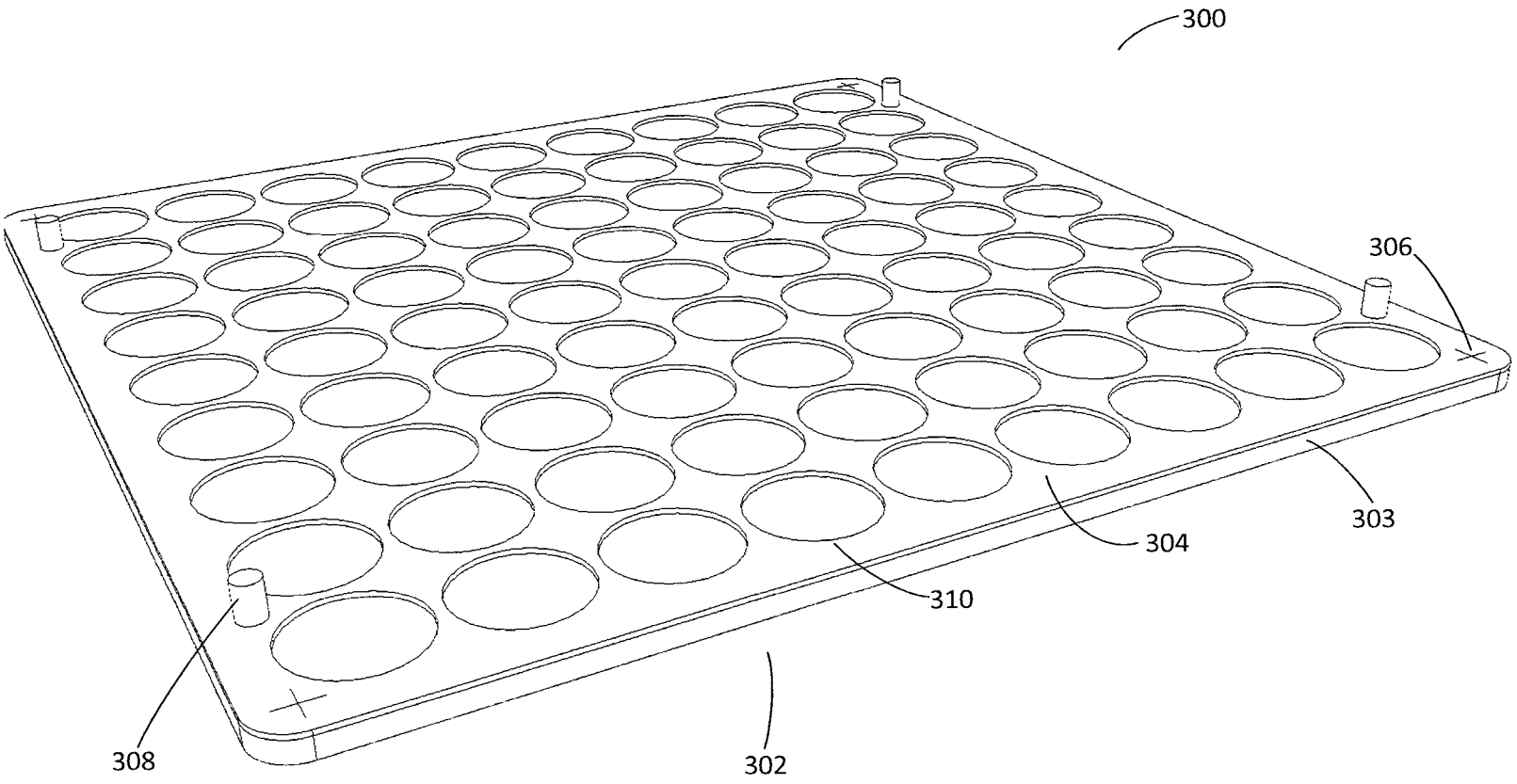
Figure 4B:
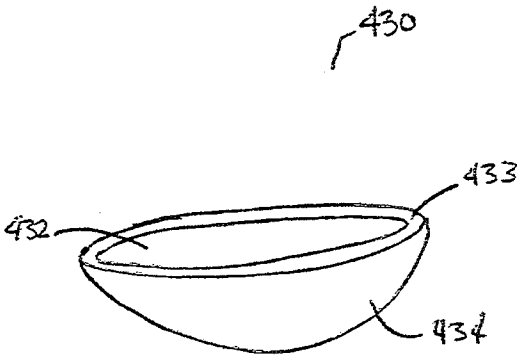
Figure 4A:
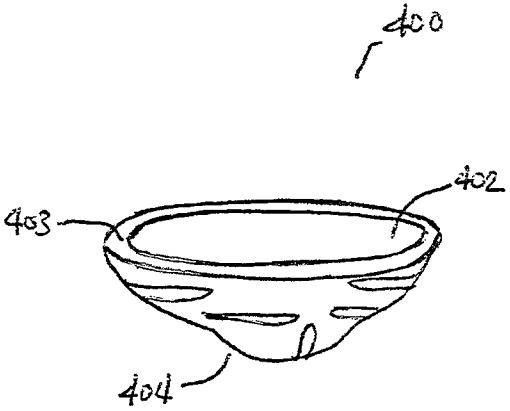
Figure 4C:
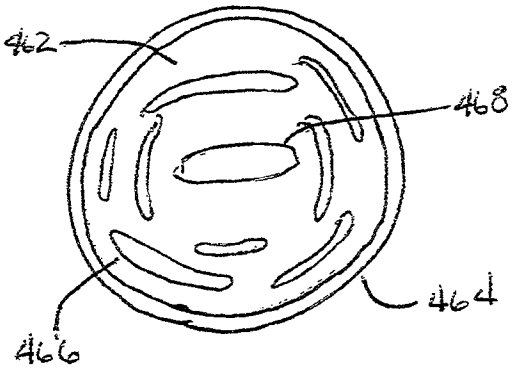
Figure 5A:
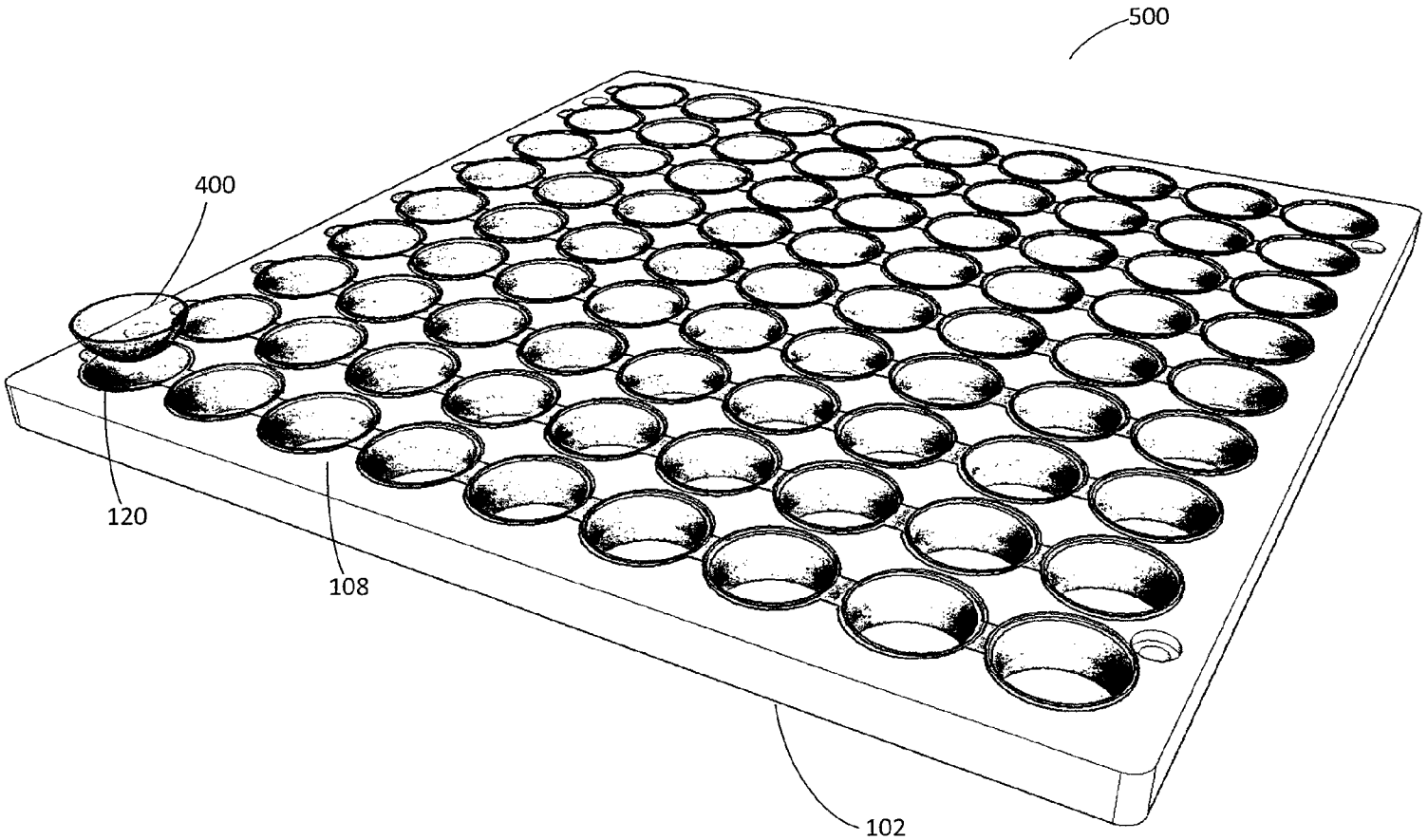
Figure 5B:
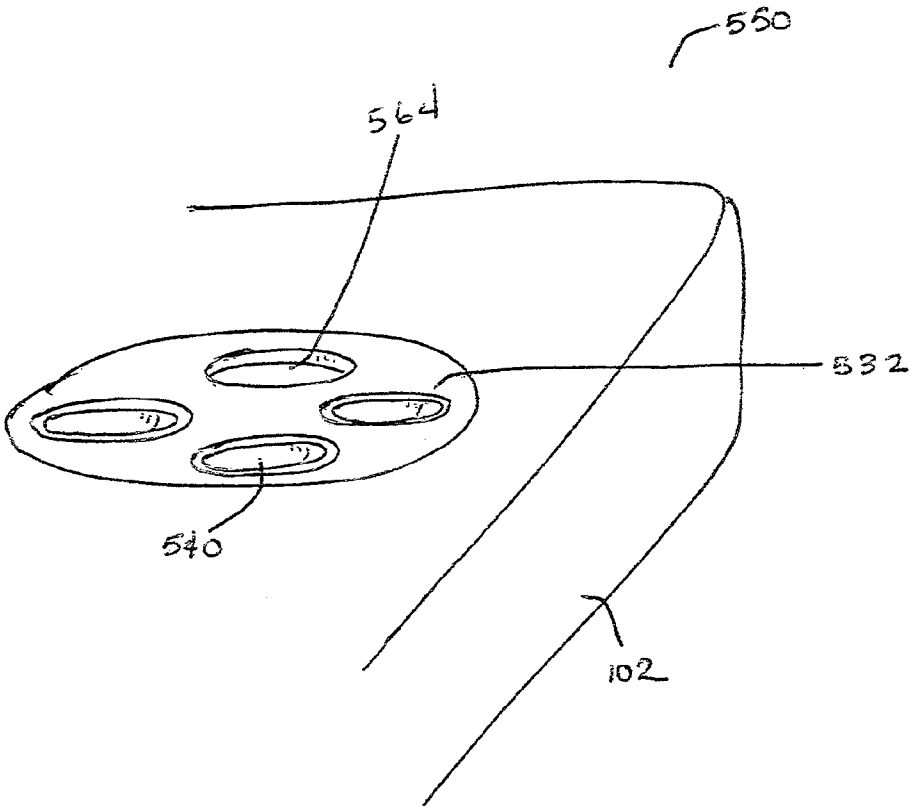
Figure 6A:
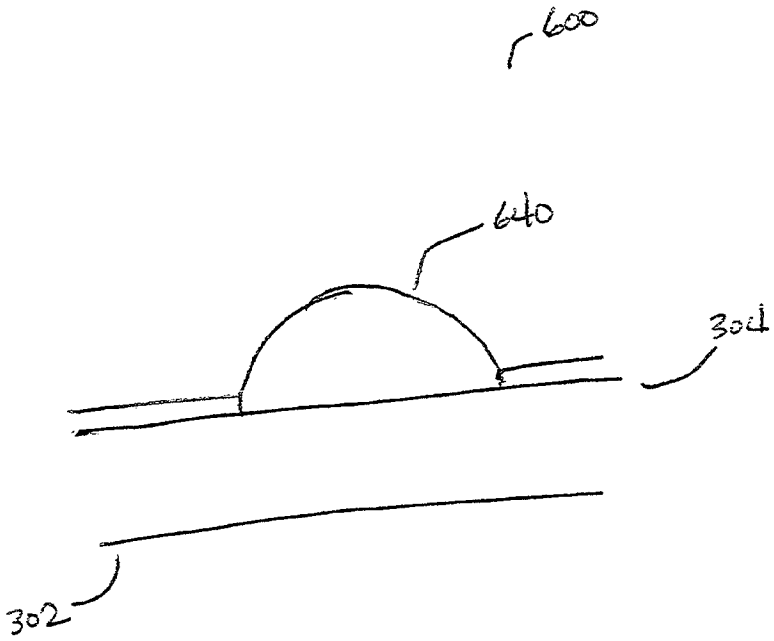
Figure 6B:
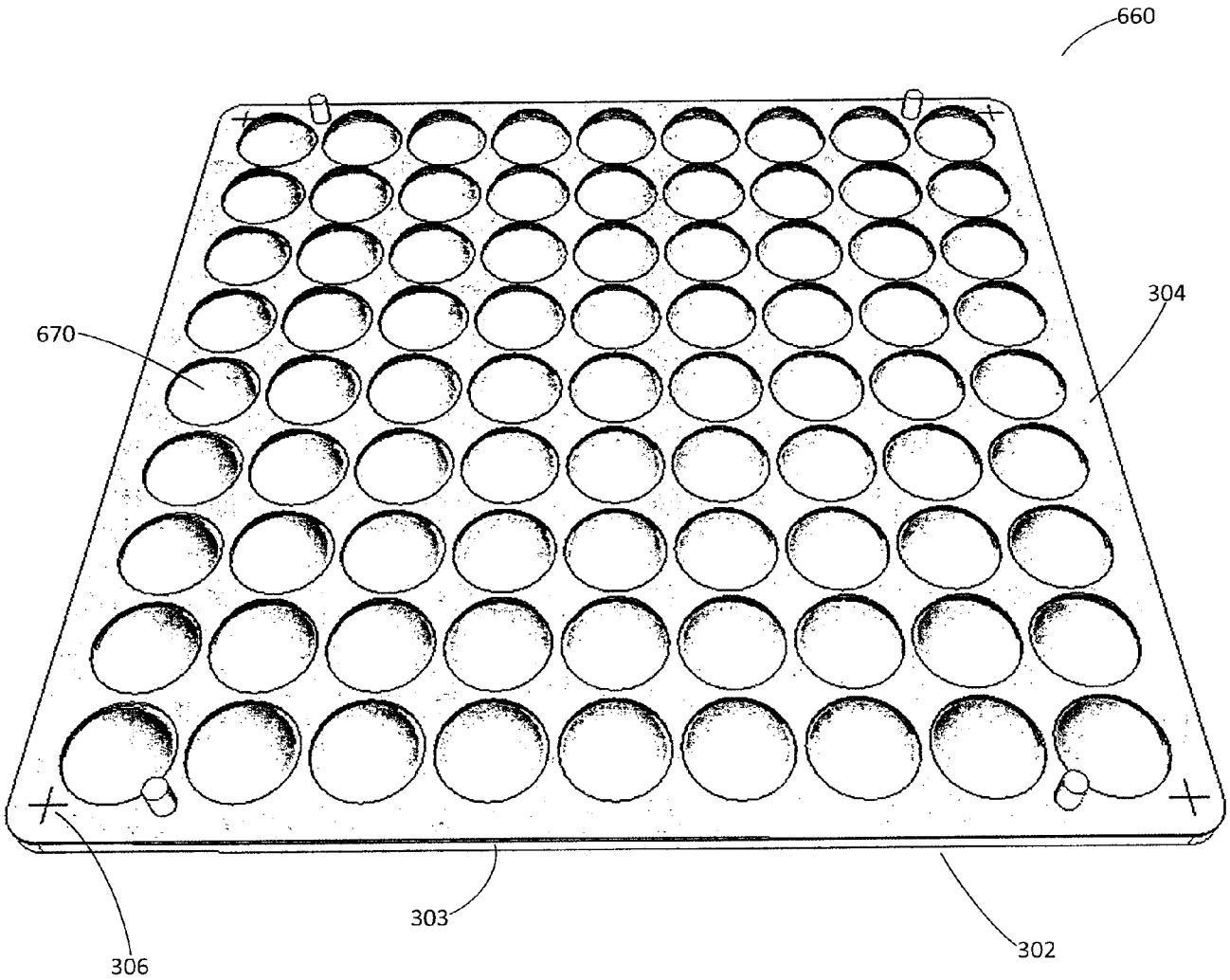
Figure 7A:
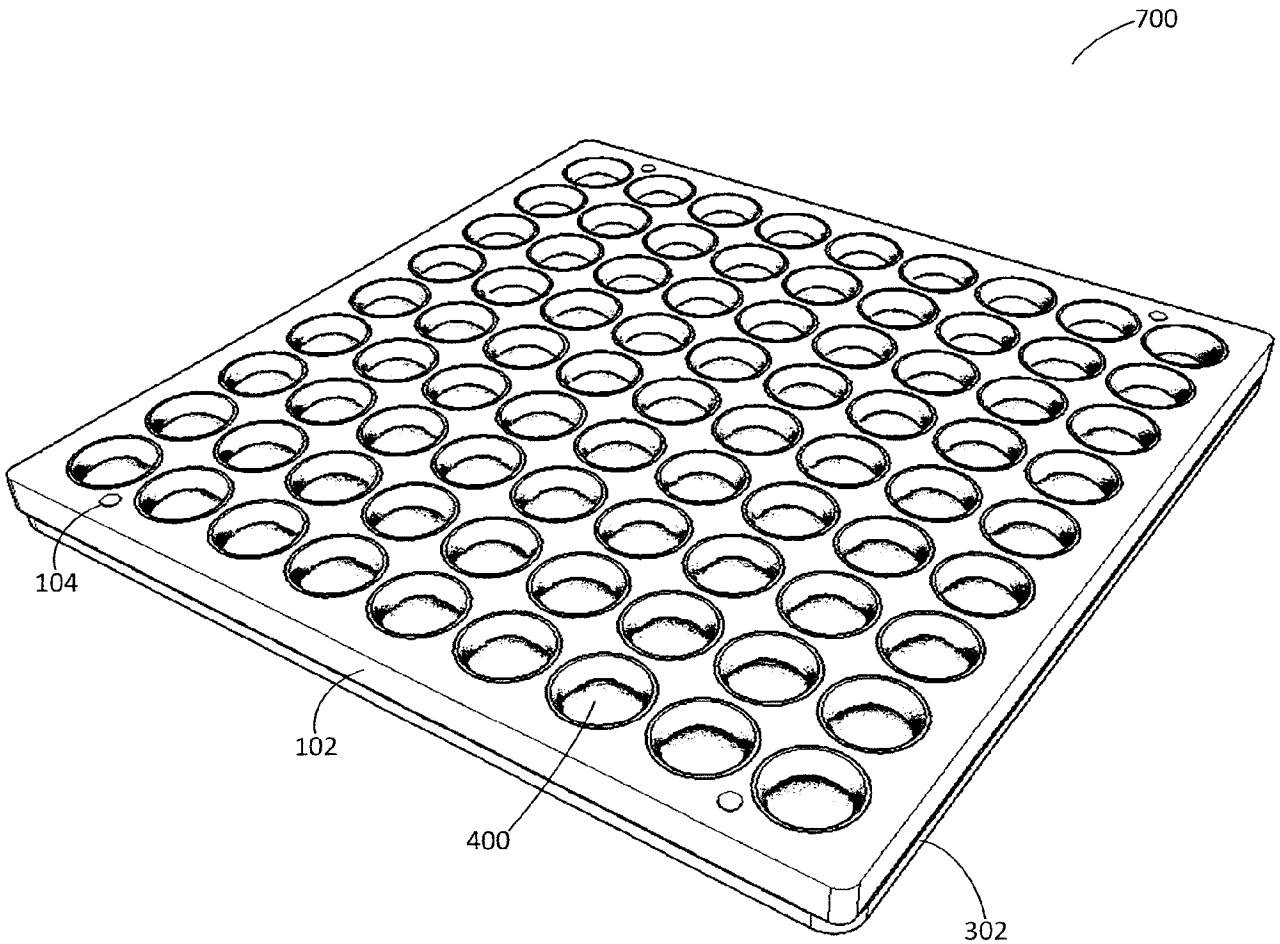
Figure 7B:
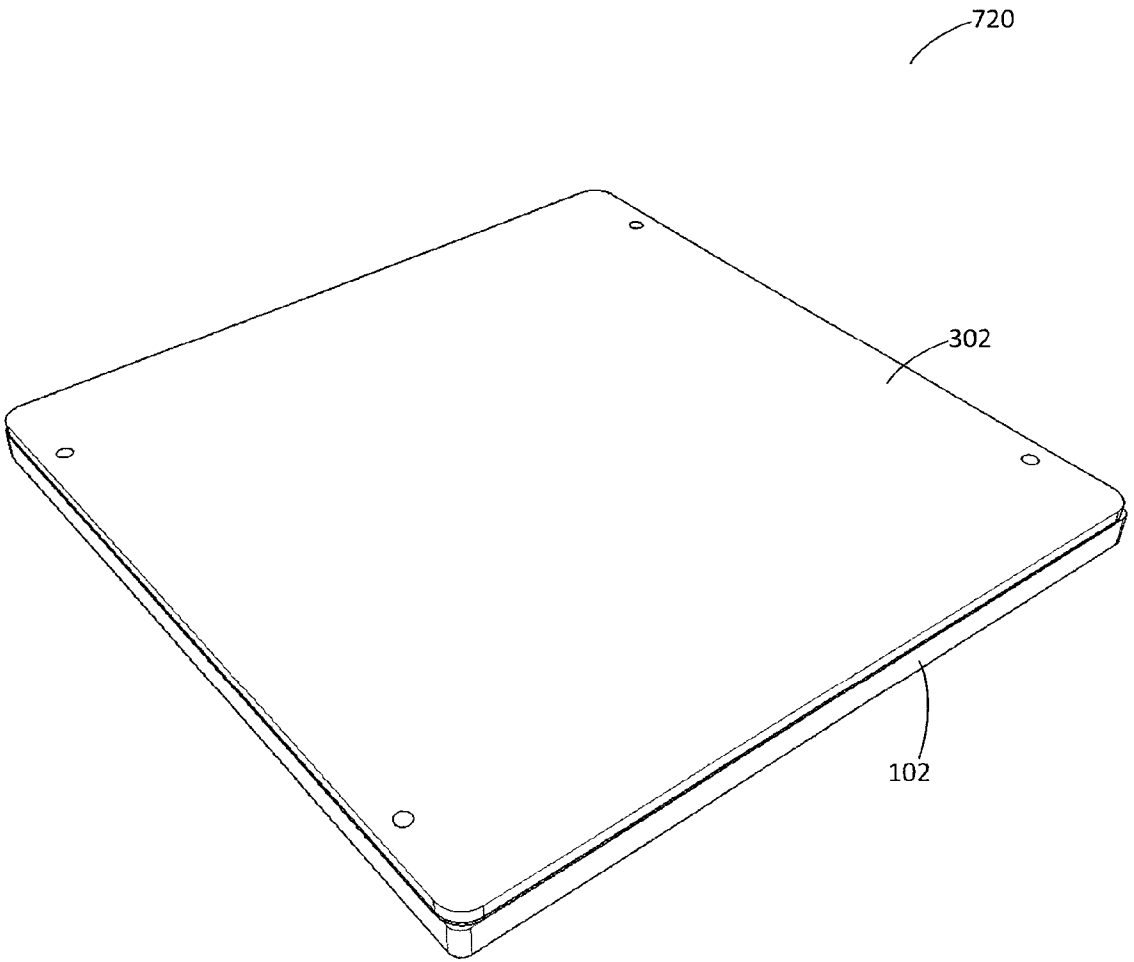
Figure 8:
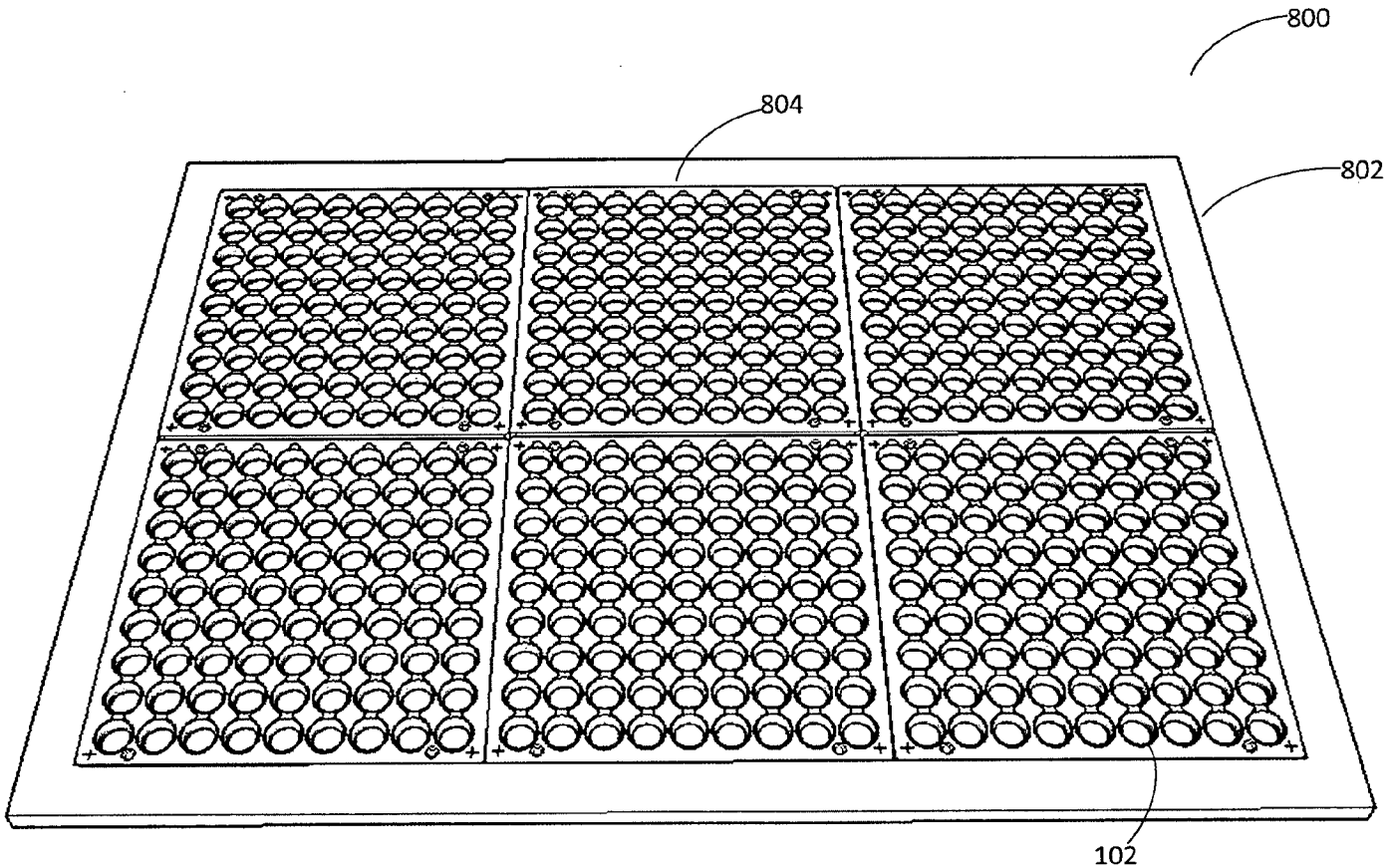
Figure 9:
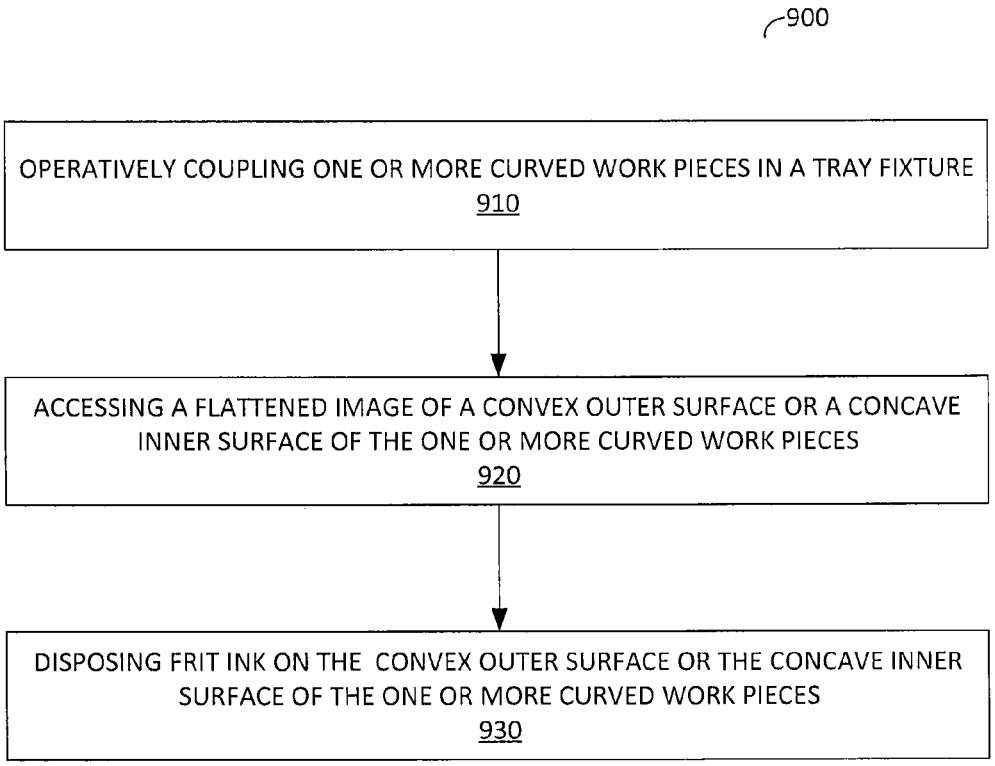
Figure 10:
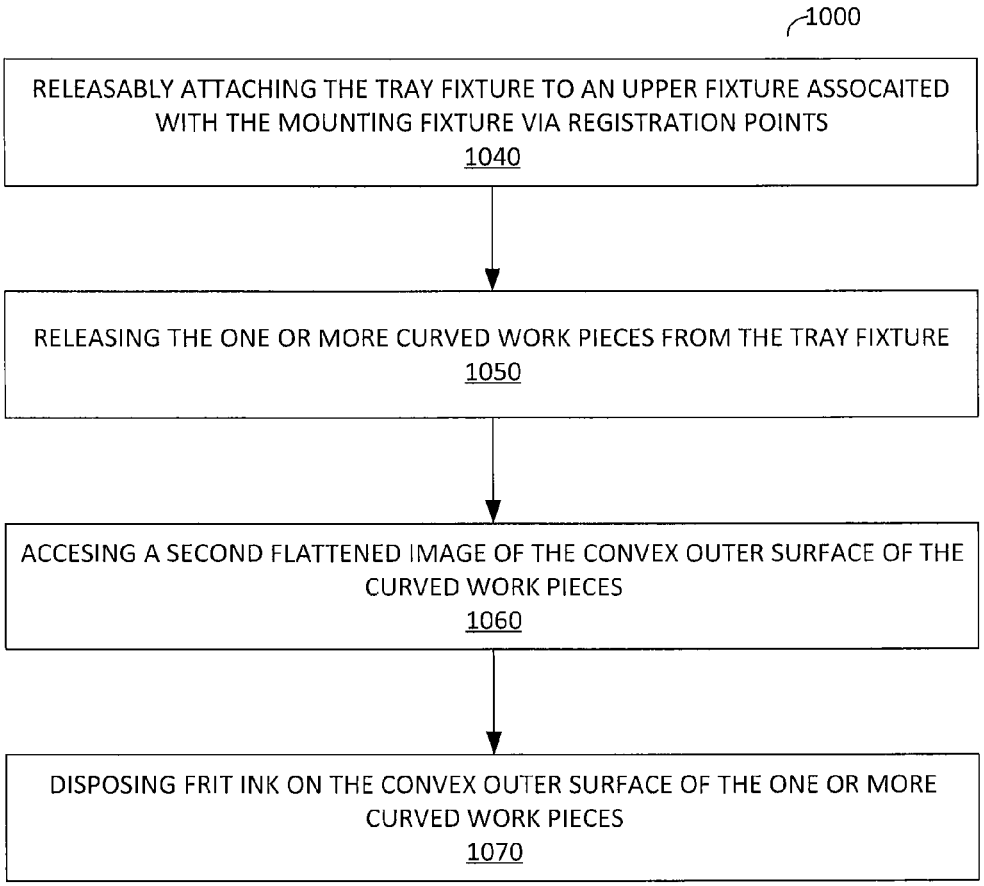
Figure 11A:
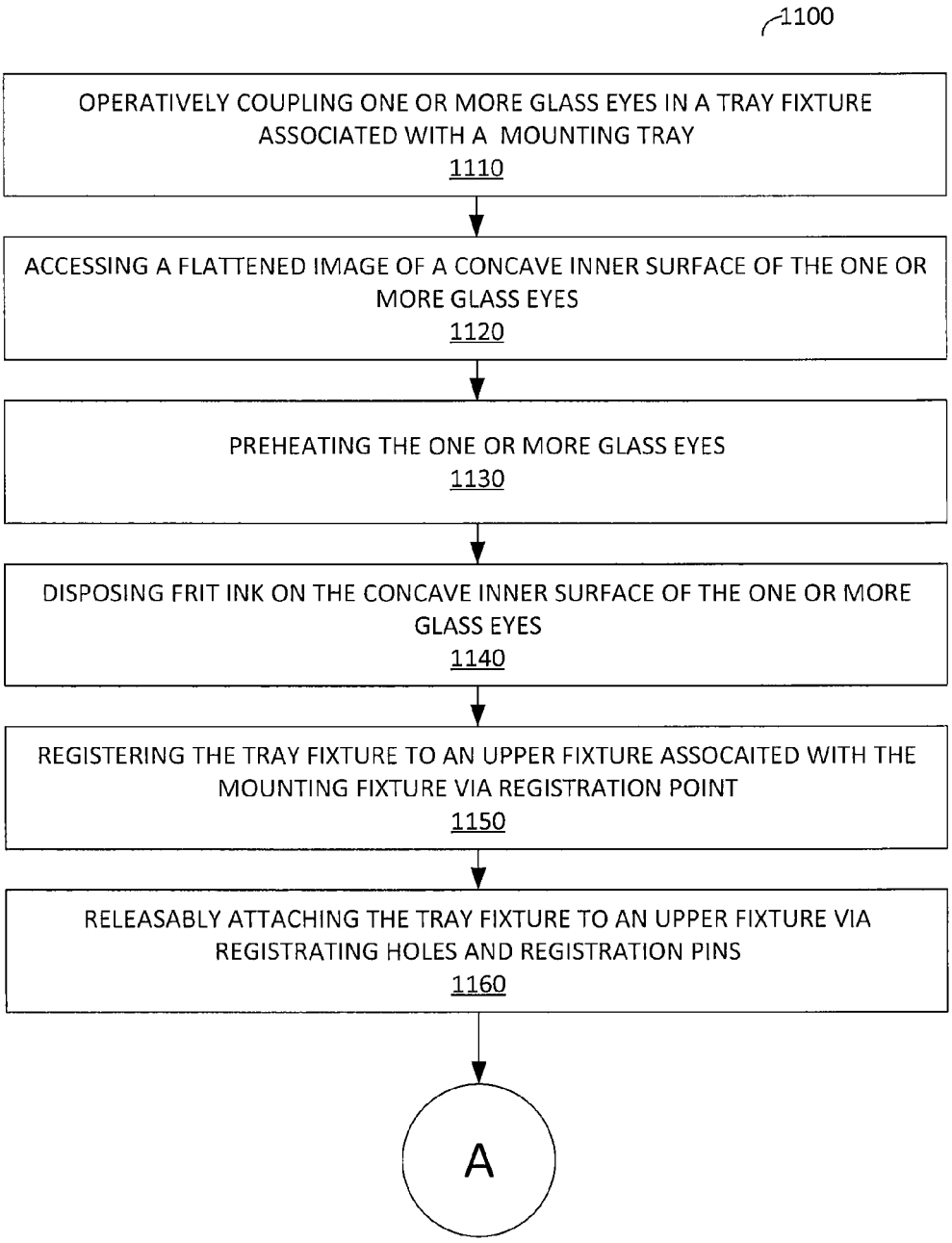
Figure 11B:
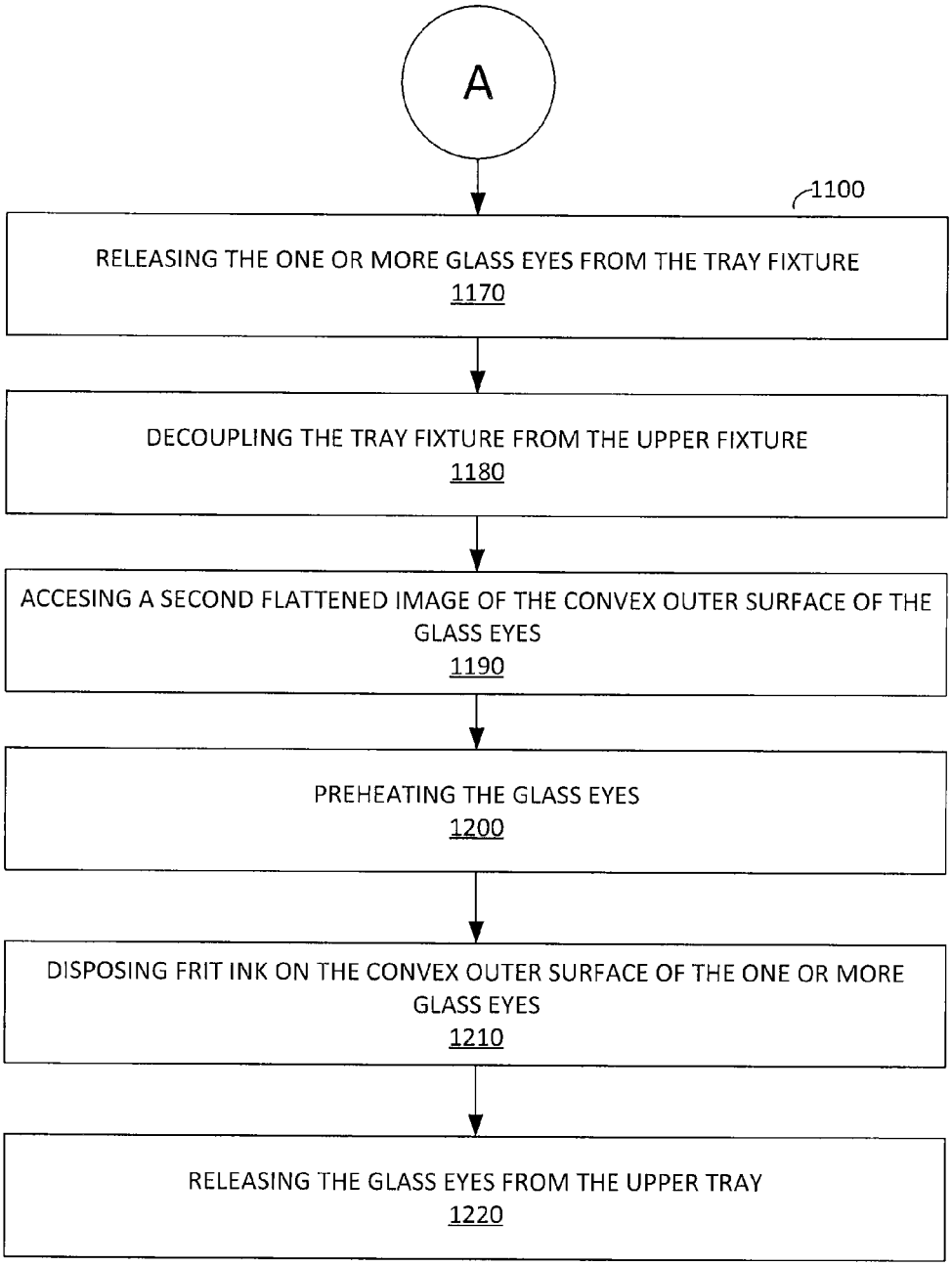

Having thus described embodiments of the invention in general terms, reference will now be made to the accompanying drawings, where:

FIG. 1 is a perspective view of an apparatus configured to releasably hold one or more curved glass members for printing the concave surface of each of the one or more curved glass members, in accordance with several embodiments of the present invention;

FIG. 2A is a perspective view of a holder for registering one or more curved glass members for printing the concave surface of each of the one or more curved glass members, in accordance with several embodiments of the present invention;

FIG. 2B is a cross-sectional view of the holder, in accordance with the several embodiments of the present invention;

FIG. 3 is a perspective view of a tray fixture configured to releasably hold one or more curved glass members for printing the convex surface of each of the one or more curved glass members, in accordance with several embodiments of the present invention;

FIG. 4A is a perspective view of a curved glass eye, in accordance with several embodiments of the present invention;

FIG. 4B is a sectional view of a curved glass eye, in accordance with several embodiments of the present invention;

FIG. 4C is a side view of a curved glass eye, in accordance with several embodiments of the present invention;

FIG. 5A is an operational view of a tray fixture releasably holding a glass eye for printing the concave surface of the glass eye, in accordance with several embodiments of the present invention;

FIG. 5B is an operational view of an alternative embodiment of a holder and tray fixture releasably holding multiple glass eyes for printing the concave surface of each of the glass eyes, in accordance with several embodiments of the present invention;

FIG. 6A is an operational view of an backing fixture releasably holding a glass eye for printing the convex surface of the glass eye, in accordance with several embodiments of the present invention;

FIG. 6B is an operational view of an backing fixture releasably holding a glass eye for printing the convex surface of the glass eye, in accordance with several embodiments of the present invention;

FIG. 7A is an operational view of a mounting fixture, in accordance with several embodiments of the present invention;

FIG. 7B is an alternate view of the mounting fixture, in accordance with several embodiments of the present invention;

FIG. 8 is an operational view of an assembly of mounting fixtures printing, in accordance with multiple embodiments of the present invention;

FIG. 9 is a process flow illustrating a process for printing a convex surface, in accordance with several embodiments of the present invention;

FIG. 10 is a process flow illustrating a process for printing a concave surface, in accordance with several embodiments of the present invention;

FIG. 11A is a process flow illustrating a process for printing curved glass eyes, in accordance with several embodiments of the present invention; and FIG. 11B is a process flow illustrating a process for printing curved glass eyes, in accordance with several embodiments of the present invention.

DETAILED DESCRIPTION OF EMBODIMENTS OF THE INVENTION

The present inventions are described in the following by referring to drawings of examples of how the inventions can be made and used. In these drawings, reference characters are used throughout to indicate like or corresponding parts. The embodiments shown are described herein are exemplary. Many details that are well known in the art are neither shown nor described.

It should be understood that "operatively coupled," when used herein, means that the components may be formed integrally with each other, or may be formed separately and coupled together. Furthermore, "operatively coupled" means that the components may be formed directly to each other, or to each other with one or more components located between the components that are operatively coupled together. Furthermore, "operatively coupled" may mean that the components are detachable from each other, or that they are permanently coupled together.

Although specific terms are employed herein, they are used in a generic and descriptive sense only and not for purposes of limitation. In addition, where possible, any terms expressed in the singular form herein are meant to also include the plural form and/or vice versa, unless explicitly stated otherwise. Accordingly, the terms "a" and/or "an" shall mean "one or more."

Specific embodiments of the invention are described herein. Many modifications and other embodiments of the invention set forth herein will come to mind to one skilled in the art to which the invention pertains, having the benefit of the teachings presented in the foregoing descriptions and the associated drawings. Therefore, it is to be understood that the invention is not to be limited to the specific embodiments disclosed and that modifications and other embodiments and combinations of embodiments are intended to be included within the scope of the appended claims. As such, it will be understood that, where possible, any of the advantages, features, functions, devices, and/or operational aspects of any of the embodiments of the present invention described and/or contemplated herein may be included in any of the other embodiments of the present invention described and/or contemplated herein, and/or vice versa.

While the foregoing disclosure discusses illustrative embodiments, it should be noted that various changes and modifications could be made herein without departing from the scope of the described aspects and/or embodiments as defined by the appended claims. Furthermore, although elements of the described aspects and/or embodiments may be described or claimed in the singular, the plural is contemplated unless limitation to the singular is explicitly stated. Additionally, all or a portion of any embodiment may be utilized with all or a portion of any other embodiment, unless stated otherwise.

Generally, the term register or reference shall refer to aligning a piece between one or more points, such as reference points, typically for transferring the piece from a first reference point to a second reference point. Furthermore referencing or registering objects within a holder may be aligning them in a proper orientation, position, location, or the like for printing. A first reference point may be designed to operatively couple with the piece in a particular manner. An opposite reference point may also be designed to operatively couple with the piece while the piece is operatively coupled with the first reference point. Therefore, the piece may be operatively coupled with both the first reference point and the opposite reference point. Generally registration of the piece may be performed using techniques or devices for registering the piece. Such technique might include aligning marks located on holders. Devices might include using pins and holes.

The term curved work piece, work piece, curved piece, curved surface, and/or curved glass piece may include a plastic, glass, plexi-glass, or silicon containing piece that include a curvature to one or more sides of the piece. In some embodiments, the curved work piece may be in the shape of an eye or a part of an eye of a human or animal. In some embodiments, a portion of the curved work piece may be flat. In some embodiments, the curvature may be subtle and only have one or more portions not being flat. In other embodiments, the curvature may be parabolic, semi-parabolic, circular, semi-circular, angled, wedge shaped, concave, convex, generally concave, generally convex, curved, aspherical, spherical, hemispherical, containing convex and/ or concave surfaces, other non-flat surface, or the like. Furthermore, in other embodiments, the curvature may be complex dual parabolic or semi-parabolic curvatures on one or more sides of the work piece. In the embodiments, illustrated throughout, a curved work piece, work piece, curved piece, curved surface, curved glass piece, glass eye, and/or curved glass eyes may be used for describing a piece that may comprise a curvature to one or more sides of the piece.

The term glass, as used herein may refer to any glass, plastic, plexi-glass, silicon, or the like material that may be formed into a work piece and provide a transparent coloring. The term transparent may refer to any clear, semi-clear, transparent, semi-transparent, or opaque coloring or lack of coloring. The term pigment, pigmented ink, or ink, as used herein may refer to any material or solution being applied to a work piece. This color may be in the form of fret ink, digital ink, jet ink, dyes, stains, oils, shellacs, inks, films, dips, or the like and may be a solid or liquid application. The pigment may, in some embodiments, provide coloring to the work piece to generate a realistic looking eye of an animal or a human.

The present invention is directed towards systems and methods for disposing pigment on a curved pieces, specifically those shaped like a human or animal eye, and apparatus for supporting and hold work pieces for printing on a curved pieces of the work pieces. More specifically, the invention is directed towards printing or disposing ink on curved pieces and holding the curved pieces for the printing process. While throughout this application one or more of these surfaces may be stated, one of ordinary skill in the art may appreciate that one or more other of these surfaces may be substituted.

In some embodiments, various curved pieces are registered and operatively coupled to at least a portion or part of a mounting fixture in such a way that a curved pieces of the glass pieces are exposed for printing. In various embodiments, the invention interacts with a printing device that disposes a pigmented ink on the curved pieces. Typically, such printing devices are configured to dispose ink on flat glass surfaces. As such, the invention provides the printing device computer systems with a flattened image of the curved pieces that allows the printing device to perform the print on the curved pieces. The flattened image is generally a distorted view of the 3-D image desired to be printed. The flattened image is the same general circumference of the curved pieces, however the pixilation of the flattened image may be condensed or elongated in various portions to achieve the desired 3-D image upon disposition of ink.

Generally, the printing device may include technology that allows the pigmented ink to print and dry simultaneously, thus preventing the pigmented ink from smearing. However, for printing on curved pieces that are glass or plastic, the curved pieces may need to be heated to a certain temperatures to prevent the pigmented ink from running after application. The printing device generally has a printing head the does not come in contact with the curved pieces. Instead, the printing head is placed a given distance away from the curved pieces and disposes ink onto the curved pieces at the given distance. The flow of ink out of the head is monitored to prevent running of the ink on the curved pieces. It is typical for the printing head to be configured to print multiple colors. The typical printing head will travel at least linearly when printing and print in sections. Similar to a standard printer, the head will print line by line, where each line is a given distance apart. The printing device will control the printing head by directing the printing head to dispose ink at a given interval. The printer may further include a table or bed for holding the mounting fixture holding the curved pieces. In some embodiments, the printer is capable of printing multiple curved pieces simultaneously. As the printing head moves linearly, it may pass over and dispose ink multiple curved pieces.

To heat the curved pieces, the printing device may be modified to receive a heat source that travels in front of the printing head. Thus the heat source heats the curved pieces prior to printing. In some embodiments, the heat source is an infrared heat source. By keeping the curved pieces at a given temperature, the pigmented ink dries without running. In some embodiments, the pigmented ink is fit ink specifically designed for printing on curved surfaces. In some embodiments, these curved surfaces may include glass eyes of a multitude of shapes and sizes and are for taxidermy purposes.

FIG. 1 illustrates an a tray fixture for operatively coupling one or more curved pieces for disposing pigment on a concave inner surface of each of the curved pieces 100, in accordance with some embodiments of the invention. The tray fixture 102 includes and one or more holders 108, where each of the one or more holders 108 are operatively coupled to the tray fixture 102. The tray fixture 102 further comprises apertures 107 positioned in rows relative to each other. Further, each of the apertures 107 may be connected to at least one adjacent aperture by groove 105 formed into the tray fixture 102. Each of the apertures 107 of the tray fixture 102 comprises an inner surface configured to operatively connect with at least a portion of the holder 108. The grooves 105 of the tray fixture 102 are designed to operatively connect with a portion of the holder 108, as will be discussed herein.

The tray fixture 102 further comprises one or more registration holes 104, one or more registration marks 106. The registration holes 104 are located on the tray fixture 102 in such a way that each of the registration holes 104 may be aligned and may be configured to receive registration pins of other devices associated with a mounting fixture, such as another tray fixture 102, a backing fixture, or the like. The registration holes 104 may further comprise a counter sunk or beveled edge to aid in aligning a tray fixture 102 with other devices associated with a mounting device. In addition to the registration holes 104, the tray may further comprise registration marks 106 for aiding a user in aligning the tray fixture 102 with other fixtures, the printing device, or aligning curved pieces within the tray fixture 102. The registration marks 106 are located in predetermined locations on the tray fixture 102 such that the registration marks 106 match registration marks located on the other fixtures associated with a mounting fixture. Furthermore the registration marks 106 may be used to register or orientate the work pieces within a tray fixture 102 such that printing the work pieces is done in a uniform manner. It is important to note that the registration marks 106 may be permanent to the tray fixture 102 and may either be marked on the tray fixture 102 by any permanent means, such as inscribing. The registration marks are generally inscribed using a precision instrument ensuring the registration marks 106 align within a given tolerance with the registration marks of the other fixtures of the mounting fixture. With respect to the number of registration holes 104 and registration marks 106, at minimum, there must be at least two registration points to properly align the tray fixture 102. These registration points may be any combination of registration holes 104 and registration marks 106. Generally however, the more registration points that exist, a higher degree of alignment will exist between the tray fixture 102 and other fixtures associated with the mounting fixture. In some embodiments, the registration marks 106 may comprise a transparent window the passes through the entirety of the tray 106. The registration mark 106 may be inscribed on the window which allows a user to view through the window to align the registration mark 106 of the tray fixture 102 with the registration mark of other fixtures.

In some embodiments, the tray fixture 102 comprises heat or torsion resistant material. Other factors that may define the material to be used is density of the material and rigidity of the material. With respect to weight, an ideal material for the tray fixture 102 would allow an average operator to pick up and carry the tray without risk of injury and excess fatigue. Further, with respect to rigidity, the material needs to be rigid enough to prevent the movement of the curved pieces when they have been registered in the holders 108. In some embodiments, an ideal material for the tray fixture 102 would be an aluminum alloy. In other embodiments, heat resistant composite materials would also be utilized.

The tray fixture 102 may be designed such that the thickness of the tray fixture 102 prevents a portion of the curved piece from crossing a bottom plane of the tray fixture 102. Additionally, the thickness of the tray fixture 102 may be designed such that the tray fixture 102 does not interfere with the printing device during the operation of the printing device. Typically, the fixture tray 102 is rectangular in shape and may have rounded corners. However, the trays may be any shape so long as the shape of the tray does not interfere with disposing the ink on the curved pieces.

FIG. 2A illustrates a holder 108 for operatively coupling with one or more curved pieces for exposing a curved portion, such as a convex portion, of the curved piece for printing, in accordance with some embodiments of the invention. The holder 108 comprises at least one or more rings 120 that are held together by one or more connection pieces 124. The ring 120 comprises a convex or semi-torus inner surface 130 configured to operatively couple with one of the curved pieces. Furthermore, the holder 108 comprises a tab 122 located on at least one end of the holder 108. Each ring 120 comprises a relatively flat outer surface 132 configured to contact the inner surface of an aperture of the tray fixture 102. The semi-torus inner surface 130 of each ring 120 comprises a convex surface extending inward into the aperture. In this way, when the curved piece in registered in and operatively coupled to the ring 120, the semi-torus inner surface 130 of the ring 120 contacts and operatively couples the convex surface of the curved piece, such that the concave surface of the curved piece is exposed for printing. In some embodiments, the semi-torus inner surface 130 contacts the outer surface of a curved work piece and allows an inner surface of the curved work piece to be positioned for printing. In other embodiments, the semi-torus inner surface 130 frictionally holds a portion of a curved work piece. The ring 120 is formed such that it comprises an aperture that passes though the entirety of the ring 120. In some embodiments, the aperture does not pass through the entirety of the ring 120 thus forming a bottom surface on the ring 120. The tab 122 of the holder 108 aids a user in removing the holder 108 from the groove of the tray fixture 102. The groove of the tray fixture 102 may be configured to allow for easy access to the tab 122.

The material used for the holder 122 may include heat resistant properties and is designed to be moldable such that the ring 120 deforms to the surface of the curved piece when the curved piece is registered with the ring 120. Additionally, the material may be moldable to aid in removing the curved piece from the ring 120. In one embodiment, a silicone or moldable plastic based material could be used for creating the holder.

FIG. 2B further illustrates a cross-sectional view of a tray fixture 200, in accordance with some embodiments of the invention. The tray fixture 102 comprises a ring 120 which is part of the holder 108, operatively coupled with the tray fixture 102. The ring 120 comprises a convex or semi-torus inner surface 130 configured to operatively couple with one of the curved pieces. The ring 120 comprises a flat outer surface 132 adapted to operatively couple to the tray fixture 102. As discussed previously, the ring 120 is designed to operatively couple a curved piece. In some embodiments, a convex surface of the curved piece, such as a curved glass eye, contacts the ring 120. In some embodiments, the inner rounded surface 130 may further be configured to hold the curved piece in such a way that the curved piece is flush with a top surface of the ring 120. In other embodiments, the inner rounded surface 130 may be configured to hold the curved piece such that the curved piece partially extrudes passed the top surface of the ring 120. The flat outer surface 132 of the ring 120 is configured to operatively contact the groove of the tray fixture 102 such that the holder does not move excessively when inserted into the groove.

FIG. 3 illustrates a backing fixture 300 for releasably holding one or more curved pieces for printing the convex surface of the curved pieces, in accordance with some embodiments of the invention. The backing fixture 302 comprises a mounting surface 303 and a gasket 304 located over the mounting surface 303. The backing fixture 302 is associated with the mounting fixture, which also includes the tray fixture. The gasket 304 operatively attaches to the mounting surface 303 such that a bottom surface of the gasket 304 contacts a top surface of the mounting surface 303. The mounting surface 303 further comprises one or more registration pins 308 attached to the mounting surface 303 and configured to register with apertures on a tray fixture. In some embodiments, the registration pins 308 are affixed to the mounting surface 303. Similar to the registration holes of the tray fixture, the registration pins 308 of the mounting surface 303 are positioned such that the pins 308 may be registered with the registration holes of the tray fixture for aligning the tray fixture with the mounting surface 303.

Materials used to construct the mounting surface 303 may be based on similar properties as that of tray fixture. Typically, the shape of the backing fixture 302 may be designed to match the shape of the tray fixture. For handling purposes the width of the backing fixture 302 may be different than the width of the tray fixture for improving handling of the tray fixture and the backing fixture 302. By differing the widths of the backing fixture 302 and the tray fixture, when the backing fixture 302 and the tray fixture are registered and coupled, the differing widths form a lip between the fixtures which aids in decoupling the fixtures. In other embodiments, in order to aid in handling the fixtures, the backing fixture 302 and/or the tray fixture may further comprise handles. The handles may be attached to the associated fixture or be formed into the fixture.

The gasket 304 comprises one or more registration marks 306 and one or more apertures 310, wherein the apertures 310 are configured to pass through the gasket 304 such that a portion of the mounting surface 303 is exposed under the aperture 310. The registration marks 306 of gasket 304 are configured to match the registration marks of the tray fixture for aligning the tray fixture to the mounting surface 303. The registration marks 306 are located on a surface of the gasket 304. The size of the aperture 310 may be designed to receive and register a curved piece. The location of each of the apertures 310 may be based on the location of the rings of the holders of the backing fixture, where the apertures 310 are concentric with the rings. The material of the gasket 304 may be designed for heat resistance and for an ability to grip at least a portion of the curved piece, including but not limited to silicone or rubber.

FIG. 4A presents a curved glass eye 400, in accordance with several embodiments of the present invention. The curved glass eye 400 comprising a generally concave or partially concaved inner surface 402, an aspherical outer surface 404, and an adjoining surface 403 that connects the concave surface 402 with the aspherical surface 404. The curved glass eye 400 may be formed to resemble any type of eye (e.g. animal, human, or the like).

Referring now to FIG. 4B, FIG. 4B further presents the curved glass eye 430, in accordance with several embodiments of the present invention. The curved glass eye 430 comprises an inner surface 432 and an outer surface 434. The curved glass eye further comprises an adjoining surface 433 that connects the inner surface 432 with the outer surface 434. The curved glass eye 430 in this illustration is generally convex or partially convex.

Referring now to FIG. 4C, FIG. 4C further presents the curved glass eye 460, in accordance with several embodiments of the present invention. The curved glass eye 460 comprises an inner surface 462 and an outer surface 464. Wherein the inner surface 462 comprises inner radial grooves 466 formed into the concave surface 462 of the curved glass eye 460, and a pupil 468 formed into the inner surface 462 of the curved glass eye 460. The pupil 468 may be formed to resemble any type of eye. As depicted in FIG. 4C, the pupil 468 is elongated. In other embodiments, the pupil may be circular. The depth and shape of the pupil 468 in the concave surface 462 may be based on an amount of reflectivity of the eye.

The inner surface 462 may further comprise radial grooves 466 formed into the inner surface 462 for adding a realistic effect to the curved glass eye 460. In some embodiments, the radial grooves 466 are positioned such that the radial grooves are located radially to the pupil 468. Each radius of the radial grooves 468 are at least a different radius as another radial groove 468. The length of the radial groove 468 may less than a full circle.

FIG. 5A presents an operational view 500 of a tray fixture, in accordance with some embodiments of the invention. The tray fixture 102 is illustrated releasable holding a curved glass eyes 400 for printing on the concave surface of each of the curved glass eyes 400. Each of the curved glass eyes 400 are registered to a ring 120 of the holder 108 of the tray fixture 102. The convex surface of the curved glass eye 400 contacts the inner torus shaped surface of the ring, thus the curved glass eye 400 is releasably connected to the inner rounded surface of the holder 108. Therefore, the concave surface of the curved glass eye is exposed for printing. One curved glass eye 400 may be registered to each ring 120.

Referring now to FIG. 5B, FIG. 5B presents an operational view 550 of the tray fixture, in accordance with some embodiments of the invention. The tray fixture 102 comprises a holder 532 operatively coupled to the tray fixture 102. The holder 532 illustrated in FIG. 5B comprises multiple rings 534. Each ring is configured to operatively coupled with a curved glass eye 540 to expose the concave inner surface of the curved glass eye 540 for printing. Each ring 534 positions the curved glass eye 540 in such a manner that the curved glass eye 540 is referenced to a printing head such that when the printing head passes over, it may dispose ink on the glass eye in accordance with a flattened image of the concave inner surface of the curved glass eye.

FIG. 6A presents a sectional view 600 of a backing fixture releasably holding a curved glass eye for printing the convex surface of the curved glass eye, as illustrated in some embodiments of the invention. A curved glass eye 640 is registered to the aperture created in the backing fixture 302, where the aperture is formed out of the gasket 304. Thus an inner wall of the aperture formed by the gasket 304 contacts at least a portion of the convex surface of the curved glass eye 640. Additionally, the bottom edge of the curved glass eye 640 contacts an upper surface of the mounting surface of the backing fixture 302. Thus, the upper surface of the mounting surface provides support to the curved glass eye 640 and positions the curved glass eye 640 with the convex surface positioned away from the backing fixture 302 for printing the convex surface of the curved glass eye 640.

Referring now to FIG. 6B, FIG. 6B illustrates an operational view 660 of a backing fixture configured to operatively coupled with multiple curved glass eyes, in accordance with some embodiments of the invention. The backing fixture 302 comprises a mounting surface 303 and a gasket 304 located over and operatively coupled with the mounting surface 303. The mounting surface 303 comprises one or more registration pins 308 attached to the mounting surface 303 and configured to register with apertures on an adjoining fixture. In some embodiments, the registration pins 308 are affixed to the mounting surface 303 of the backing fixture 302.

The gasket 304 comprises one or more registration marks 306 and one or more apertures 310, wherein the apertures 310 are configured to pass through the gasket 304 such that a portion of the mounting surface 303 is exposed under the aperture 310. Similar to the registration marks of tray fixture, the registration marks 306 of gasket 304 are configured to match the registration marks of an adjoining fixture for aligning the adjoining fixture to the mounting surface 303. Furthermore, the registration marks 306 are used to orientate and register the curved glass eye 670 for printing in the correct orientation. The registration marks 306 are located on a top surface of the gasket 304. The size of the aperture 310 may be designed to receive and register a curved glass eye 670. The sides of each of the apertures 301 may contact with a surface of the curved glass eye 670 to register the curved glass eye 670 for printing.

FIG. 7A illustrates an operational view 700 of a mounting fixture, in accordance with one embodiment of the present invention. The mounting fixture comprising at least a tray fixture 102 and a backing fixture 302. Furthermore, multiple curved glass eyes 400 are illustrated as being registered within the tray fixture 102 and the backing fixture 302. The tray fixture 102 is operatively coupled to the backing fixture 302. The tray fixture 102 may be operatively coupled with the backing fixture 302 by registering the registration holes 104 of a tray fixture 102 with the registration pin of the backing fixture 302. Alternatively, any means of registration of an orientation of the tray fixture 102 with the backing fixture 302 in order to position the curved work pieces may be used, this may include, but is not limited to guidelines, pins, rabbits, grooves, markings, or the like. When the tray fixture 102 and the backing fixture 302 are operatively coupled, the curved glass eyes 400 are registered to both the tray fixture 102 and the backing fixture 302. However, when the tray fixture 102 and the backing fixture 302 are initially operatively coupled, the curved glass eyes 400 are operatively coupled to the fixture tray fixture 102. The mounting fixture may be inverted to aid in releasing each of the curved glass eyes 400. Force may be applied through the apertures of the tray fixture 102 such that the curved glass eyes 400 release from the tray fixture 102. After releasing, the curved glass eyes 400 operatively coupled with the backing fixture 302 as further illustrated above in FIGS. 6A and 6B. The tray fixture 102 and the backing fixture 302 may be decoupled and the curved glass 400 remain operatively coupled to the backing fixture 302 in such a way that the convex outer surface of the curved glass eyes 400 are exposed for printing.

FIG. 7B illustrates an operational view 720 of the mounting fixture, in accordance with some embodiments of the invention. The backing fixture 302 is initially positioned over the tray fixture 102 via the registration points. The mounting fixture may, at that point be inverted such that the backing fixture 302 is positioned below the tray fixture 102. Force may then be applied to the curved pieces, such as a curved glass eyes to release the curved glass eyes from their position within the tray fixture 102 to a position of being operatively coupled to the backing fixture 302.

FIG. 8 illustrates an operational view 800 of an assembly, in accordance with one embodiment of the present invention. The assembly 800 comprises one or more tray fixtures 102 releasably connected to a tray holder 802. The tray holder 802 may comprises an indention 804 located in a top surface of the tray holder 802. The indention 804 is configured to operatively coupled with multiple tray fixtures 102. The tray fixtures 102 are positioned in the indention such that a bottom surface of the tray fixtures 102 contacts a top surface of the indention. The sides of the indention provide lateral support to the tray fixtures 102. Generally the sides of the indention 804 are perpendicular to a top surface of the holder 802. When the tray fixtures 102 are positioned in the indention 804 of the tray holder 802, the sides of the tray fixtures 102 make contact with one another such that they provide lateral support to each other. Thus the tray fixtures 102 are operatively coupled to the tray holder 802. Additionally, when the tray fixtures 102 are operatively coupled with the tray holder 802, the top surface of the tray fixtures 102 may be parallel with the top surface of the tray holder 802 such that the apparatus 100 are flush with the tray holder 802. In other embodiments, the depth of the indention 804 of the tray holder 802 may be configured to allow the top surface of the tray fixtures 102 to be positioned higher than the top surface of the tray holder 802.

FIG. 9 illustrates a process 900 for printing a concave surface of a curved piece, in accordance with some embodiments of the invention. The process 900 is initiated at block 910, where the one or more curved pieces are operatively coupled into a tray fixture and registered. The tray fixture comprises holders located within apertures in the tray fixture, where the holders are configured to releasably hold each of the curved pieces. The curved pieces are registered to the holders by causing the convex surface of each of the curved pieces to contact the holder such that the concave surface is facing away from the surface of the tray allowing the concave surface to be exposed. The holder further positions the curved pieces to align the concave surface in such a way that frit ink may be disposed on the concave surface of each of the curved pieces.

The tray fixture with the registered curved pieces may then be inserted into a machine configured to print with ink onto a glass surface using digital or otherwise technology. The machine may be configured to locate the curved pieces. In some embodiments, such configuration may be based on registering the curved pieces with the tray. In other embodiments, the machine may use optics to locate the curved pieces. While in other embodiments, the tray may further comprise registration marks that may be sensed by the machine to assist the machine in locating the curved pieces.

In some embodiments, the curved pieces may be preheated prior to printing to allow a better cohesion of the frit ink to the curved pieces. In some embodiments, tray fixtures with the registered curved pieces may be placed into an oven and preheated to a predetermined temperature. In other embodiments, the machine may comprise a heating element that heats the curved pieces prior to printing. The heating element of the machine may be operated in such a way that the heating element heats a curved piece within a preconfigured time prior to the machine printing the curved piece. Heating the curved piece may be accomplished by locating the heating element proximate to a printing head. As the printing head moves, the heating element moves ahead of the printing head heating the curved piece prior to the printing head printing the curved piece. In some embodiments, the heating element might be an infrared heat source. In some embodiments, heating may be performed by printing or initiating a printing sequence with the machine in front of the first curved piece. As the machine prints ghost images in front of the first curved piece, the machine may heat the first curved pieces via infrared light.

In some embodiments, each of the curved pieces are cleaned prior to being printed. Cleaning the curved pieces may be performed in any manner typical to cleaning glass prior to printing. In some embodiments, a low pressure air source is placed proximate to the printing head. The low pressure air source advances the printing head and blows away dust or foreign objects on the concave surface of the curved pieces prior to the printing head printing the curved pieces Next, as illustrated in block 920, the process continues by accessing a flattened 2-D image of the 3-D digital image of the work piece. Typically, a printing machine is configured to move a printing head to print on a flat two-dimensional surface. The printing machine interprets a bitmap or other two-dimensional image and translates the image for printing on the two-dimensional surface. When a printing machine attempts to place a two-dimensional image on a curved pieces, the printed image appears distorted based on the curvature of the surface. Therefore, the image must be manipulated prior to the printing machine receiving the image. In some embodiments, the image is flattened based on the curvature of the curved pieces. The higher the curvature the more the image needs to be flattened.

Flattening the image may be performed by receiving a 3-D image of a printed convex surface or the concave surface. The image may be created using 3-D modeling software, where the software creates a 3-D model of the curved piece. The model of the curved piece may comprise curved pieces. Each of the curved pieces may comprise an image mapped to the curved pieces. The model may be positioned such that a directional view of the 3-D model is obtained relative to how a curved pieces will be printed. For example, if a convex surface will be printed, the 3-D model will be viewed as from a front view of the convex surface. The printable area based on the view is measured. Based on geometric considerations, the printable area will always be smaller than the image mapped on the curved pieces of the model unless the curved pieces is flat. The image mapped on the curved pieces is flattened and will generally take up more area than the printable area. The unfolded image is remapped to the printable area based on the curvature of the surface. Remapping entails compressing the pixels of the unfolded image to the printable area. However, the compression is based on the curvature of the model. Therefore, areas of the unfolded image that are associated with areas of high curvature of the model will be compressed more than flatter areas of the model. For example, an area that is flat on the model will not be compressed while an area that has a high curve will be compressed the most. After compression, the unfolded image will be remapped to the printable area and result in the flattened image.

After the image is flattened, the printer head may interpret the image two-dimensionally but as it prints, the printed image appears undistorted. In this way, the pixilation of the flattened image may be compressed or expanded relative to what the final appearance of the image will be on the concave surface.

Next, as illustrated in block 930 the process 900 continues by disposing frit ink on the concave surface of each of the curved pieces based on the flattened image. The frit ink is typically used for printing glass because of its ability to bond to the glass surface. A printer head places the frit ink on the glass surface using the flattened image. In some embodiments, the printer head is configured to print multiple colors. In some embodiments, the machine may be configured to print the curved piece in multiple stages, where each stage consists of printing a different color on the curved piece. Each stage may be followed by a drying period to allow the print on the curved piece to dry prior to another color being applied to the curved piece.

In some embodiments, the process 900 may further comprise a step to heat the curved piece after being printed. This may be applied in multiple stages and be used for several purposes. Where the ink is applied in multiple stages, the curved piece may be heated. In some embodiments this heating is done by a heating elements located proximate to the printing head. Thus, the heating element heats the curved piece prior to a subsequent ink color being applied. Such heat from the heating elements allows the ink to dry.

In other embodiments, after all the ink has been applied, the tray with the registered curved pieces may be placed into an oven and heated to a predetermined temperature to cure the frit ink. Such process may include sintering the frit ink. After heating the curved pieces after printing, the tray may be removed and the pieces cooled.

FIG. 10 illustrates a process flow 1000 for printing a convex surface of a curved piece 1000, in accordance with some embodiments of the invention. The process 1000 is initiated by releasably attaching the tray fixture to a backing fixture associated with the mounting fixture via the use of registration points, as illustrated in block 1040. In this way, once the concave surface has been printed, as illustrated above with respect to FIG. 9, the convex surface may be painted. In some embodiments, only the convex surface of a curved piece may be printed. In other embodiments, only the concave surface of a curved piece may be printed. In other embodiments both a concave and convex surface of a curved piece may be printed. In this case, the concave surface of a curved piece may be printed first then the convex surface of the curved piece may be printed. In other embodiments, the convex surface of a curved piece may be printed first then the concave surface of the curved piece may be printed.

Step 1040 illustrates releasably attaching the tray fixture to a backing fixture associated with a mounting fixture via registration points. In some embodiments, both the backing fixture and the tray fixture include registration points that are matched for registering the backing fixture to the tray fixture. Such registration points aid a user in aligning the backing fixture and the tray fixture. When the backing fixture and the tray fixture are registered, curved pieces operatively coupled to the tray fixture will be registered to apertures of the backing fixture. Such apertures reveal a mounting surface for contacting a portion of the curved pieces. Further the sides of the apertures operatively couple with at least a portion of the curved pieces when the curved pieces are released from the tray fixture as illustrated in step 1050.

Releasing the curved pieces, as illustrated in step 150, may be performed by first inverting the mounting fixture and thus revealing the tray fixture. The tray fixture exposes an outside surface of each of the curved pieces. The curved pieces may be released by applying a force to the outside surface of each of the curved pieces. The curved pieces will decouple from the tray fixture and operatively couple with the backing fixture by contacting the sides of the aperture and the mounting surface. Typically, the tray fixture may be decoupled from the backing fixture thus revealing the backing fixture with the operatively coupled curved pieces. The outside surface of the curved pieces will be revealed and positioned for printing.

Step 1060 illustrates accessing a second flattened image of the convex outer surface of the curved pieces. The second flattened image is obtained to program a printing machine in order to dispose frit ink on the convex outer surface of the one or more curved pieces. As described above, flattening the image may be performed by receiving a 3-D image of a printed convex surface or the concave surface. The image may be created using 3-D modeling software, where the software creates a 3-D model of the curved piece. The model of the curved piece may comprise curved pieces. Each of the curved pieces may comprise an image mapped to the curved pieces. The model may be positioned such that a directional view of the 3-D model is obtained relative to how a curved pieces will be printed. For example, if a convex surface will be printed, the 3-D model will be viewed as from a front view of the convex surface. The printable area based on the view is measured. Based on geometric considerations, the printable area will always be smaller than the image mapped on the curved pieces of the model unless the curved pieces is flat. The image mapped on the curved pieces is flattened and will generally take up more area than the printable area. The unfolded image is remapped to the printable are based on the curvature of the surface. Remapping entails compressing the pixels of the unfolded image to the printable area. However, the compression is based on the curvature of the model. Therefore, areas of the unfolded image that are associated with areas of high curvature of the model will be compressed more than flatter areas of the model. For example, an area that is flat on the model will not be compressed while an area that has a high curve will be compressed the most. After compression, the unfolded image will be remapped to the printable area and result in the flattened image.

Frit ink is disposed on the convex outer surface of the curved pieces as illustrated in step 1070. The ink may be disposed by the printing surface based on the second flattened image. Generally, a printing machine using a printing head disposes the frit ink according to the flattened image.

Referring now to FIG. 11A and FIG. 11B, FIG. 11A and FIG. 11B illustrate a process 1100 for printing curved glass eyes, in accordance with several embodiments of the present invention. The process 1100 is initiated by operatively coupling and registering one or more glass eyes in one or more apertures of a tray fixture as illustrated in block 1110. Each of the one or more glass eyes comprises a convex outer surface and concave inner surface. The concave surface comprises groves that are positioned radial to the glass eye, and a marking representing a pupil located on the concave surface concentric with the curved glass eye. The tray fixture comprises a top surface, and a bottom surface that is located parallel the top surface. The one or more apertures pass through the entirety of the tray fixture from the top surface to the bottom surface. Each of the one or more apertures is configured to releasably hold one of the one or more glass eyes such that the concave surface is exposed for printing.

Next, as illustrated in block 1120, the process 1100 continues by flattening a first digital curved image of the concave surface of the glass eye. As explained herein, a printing machine is configured to move a printing head to print on a flat two-dimensional surface. The printing machine interprets a bitmap or other two-dimensional image and translates the image for printing on the two-dimensional surface. When a printing machine attempts to place a two-dimensional image on a curved pieces, the printed image appears distorted based on the curvature of the surface. Therefore, the image must be manipulated prior to the printing machine receiving the image. In some embodiments, the image is flattened based on the curvature of the curved pieces. The higher the curvature the more the image needs to be flattened. After the image is flattened, the printer head may interpret the image two-dimensionally but as it prints, the printed image appears undistorted.

Once the flattened image is accessed, the process 1100 may continue by preheating the one or more glass eyes, as illustrated in block 1130. The glass eyes may be preheated prior to printing to allow a better cohesion of the frit ink to the glass eyes. In some embodiments, a tray fixture with the registered glass eyes may be placed into an oven and preheated to a predetermined temperature. In other embodiments, the machine may comprise a heating element that heats the glass eyes prior to printing. The heating element of the machine may be operated in such a way that the heating element heats a curved piece within a preconfigured time prior to the machine printing the curved piece. Heating the curved piece may be accomplished by locating the heating element proximate to a printing head. As the printing head moves, the heating element moves ahead of the printing head heating the curved piece prior to the printing head printing the curved piece. In some embodiments, the heating element might be an infrared heat source.

Next, at block 1140, the process 1100 includes disposing frit ink on the concave inner surface of the one or more glass eyes. The tray fixture may be registered to a printing device for printing the concave inner surfaces of the one or more glass eyes. The first flattened image may be programmed into the printing device that causes a printing head to dispose the frit ink in accordance with the flattened image. In some embodiments, the preheating the one or more glass eyes and the printing of the one or more glass eyes are accomplished simultaneously. The heating element may be attached to the printing device and travel ahead of the printing head to preheat the glass eyes prior to printing. However, in order to preheat the first set of glass eyes, the printing head must be offset such that the heating element heats the first set of glass eyes. This may be accomplished by programming the machine to print ahead of the glass eyes on the surface of the tray fixture. This image is known as a ghost image. As the printing head reaches the one or more glass eyes, the printing head may transition to printing the first flattened image on the one or more glass eyes.

Next, as illustrated in block 1150 the process 1100 continues by registering the tray fixture with a backing fixture using registration marks associated with both the tray fixture and the backing fixture. By aligning the registration marks, the tray fixture and the backing fixture are configured to align to transfer the one or more glass eyes from the tray fixture to the backing fixture. Once registered, the tray fixture and backing fixture unit, the mounting fixture, may be inverted such that the backing fixture is facing downward with the tray fixture positioned there above.

Next, block 1160 demonstrates releasably attaching the tray fixture to a backing fixture via registration holes and registration pin. When the registration marks are aligned as described in block 1140, the registration holes of the tray fixture will align with the registration pins of the backing fixture. The tray fixture may be releasably attached to the backing fixture by inserting the registration pins into the registration holes. As the tray fixture is releasably attached to the backing fixture, the one or more glass eyes operatively coupled to the tray fixture will be registered with the backing fixture. However, the one or more glass eyes are not operatively coupled to the backing fixture. In some embodiments, the backing fixture comprises a gasket positioned on the base of the backing fixture such that a bottom surface of a glass eye is releasably connected to a top surface of the base, wherein the gasket comprises one or more apertures revealing at least a portion of the base, wherein each of the apertures are configured to receive each of the glass eyes.

The process 1100 is continued at block 1170 of FIG. 11B which demonstrates releasing the one or more glass eyes from the tray fixture. In some embodiments, the glass eyes may be released by applying a force to the convex surface of each the glass eyes. The force may be applied through each of the rings of the holders. After the glass eyes have been released, the one or more glass eyes become operatively coupled to the backing fixture. After operatively coupling the one or more glass eyes to the backing fixture, the tray fixture may be removed revealing the convex surfaces or each of the glass eyes.

Block 1180 demonstrates removing the tray fixture from the backing fixture thus revealing the convex outer surface of the one or more glass eyes for printing.

Next, at block 1190 a second flattened image for printing the convex outer surface of the one or more glass eyes is accessed. Using the second flattened image, the printer head may place fretted ink on the convex surface of each of the one or more glass eyes as illustrated in block 1190. Prior to printing the convex outer surface, the glass eyes must be preheated as illustrated in block 1200.

Step 1210 illustrates disposing frit ink on the convex outer surface of the one or more glass eyes. This step may be performed similar to that of step 1140 of the current process 1100. Next, after the glass eyes have been printed and heated, the glass eyes may be released from the upper tray, as demonstrated in block 1220.

What is claimed is:

1. An apparatus for holding one or more work pieces, the apparatus comprising:

a mounting fixture, wherein the mounting fixture comprises a tray fixture and a backing fixture, wherein the tray fixture and the backing fixture are capable of being releasably attached, wherein the tray fixture comprises apertures positioned in a row, and one or more holders within and operatively coupled to the apertures, wherein each of the one or more holders are configured to operatively couple with a generally convex outer surface of the one or more work pieces to reveal a second surface of each of the one or more work pieces for disposing ink on the generally convex outer surface, and wherein the backing fixture comprising a mounting surface configured to support the one or more work pieces to present a generally convex surface of each of the one or more work pieces.

2. The apparatus of claim 1, wherein the backing fixture further comprises a gasket located over the mounting surface, wherein the gasket comprises apertures configured to expose the mounting surface of the backing fixture and operatively couple with the one or more work pieces when the one or more work pieces are supported by the mounting surface, wherein a width of the backing fixture is less than the tray fixture thus exposing at least part of the tray fixture when the backing fixture and the tray fixture are releasably attached, wherein the exposed part of the tray fixture enables a user to release the tray fixture from the backing fixture.

3. The apparatus of claim 1, wherein laterally adjacent apertures of the tray fixture are connected by grooves within the tray fixture, wherein a thickness of the tray fixture is determined by the one or more work pieces, wherein the tray fixture thickness is great enough that when the one or more work pieces are operatively coupled to the tray fixture, a portion of the one or more work pieces does not extend pass a bottom surface of the tray fixture.

4. The apparatus of claim 1, wherein the mounting fixture is configured to register the one or more work pieces to the tray fixture for operatively coupling the one or more work pieces to the tray fixture, wherein the mounting fixture is further configured to register the backing fixture to the tray fixture for releasably attaching the tray fixture with the backing fixture, wherein the mounting fixture is further configured to be inverted to expose at least a portion of the one or more work pieces for applying a force to the one or more work pieces, wherein when the force is applied to the one or more work pieces, the one or more work pieces are decoupled from the tray fixture and are operatively coupled to the backing fixture.

5. The apparatus of claim 1, wherein each of the one or more holders comprises a semi-torus surface configured to operatively couple one of the one or more work pieces, wherein each of the one or more holders further comprise a flat surface located that operatively couples to an inside surface of one of the apertures of the tray fixture, wherein the holders comprise rubber or silicone.

6. The apparatus of claim 1, wherein the tray fixture and the backing fixture comprise matching registration points, wherein the registration points are located on the tray fixture and the backing fixture such that when the registration points are aligned, the one or more holders operatively coupled to the apertures of the tray fixture align with exposed mounting surface of the backing fixture.

* * * * *